US008326641B2

(12) United States Patent
Song et al.

(10) Patent No.: US 8,326,641 B2
(45) Date of Patent: Dec. 4, 2012

(54) APPARATUS AND METHOD FOR ENCODING AND DECODING USING BANDWIDTH EXTENSION IN PORTABLE TERMINAL

(75) Inventors: Geun-Bae Song, Jecheon-si (KR); Pavel Martynovich, Suwon-si (KR); Chul-Yong Ahn, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 930 days.

(21) Appl. No.: 12/407,434

(22) Filed: Mar. 19, 2009

(65) Prior Publication Data

US 2009/0240509 A1 Sep. 24, 2009

(30) Foreign Application Priority Data

Mar. 20, 2008 (KR) ..... 10-2008-0025980
Mar. 21, 2008 (KR) ..... 10-2008-0026340

(51) Int. Cl.
*G10L 19/00* (2006.01)
*G10L 21/00* (2006.01)

(52) U.S. Cl. ..... 704/503; 704/500; 704/501; 704/502; 704/504

(58) Field of Classification Search ..... None
See application file for complete search history.

(56) References Cited

U.S. PATENT DOCUMENTS 5,455,888 A * 10/1995 Iyengar et al. ..... 704/203
6,895,375 B2 * 5/2005 Malah et al. ..... 704/219
6,988,066 B2 * 1/2006 Malah ..... 704/219
7,181,402 B2 2/2007 Jax et al.
7,184,961 B2 * 2/2007 Sato ..... 704/501
7,216,074 B2 * 5/2007 Malah et al. ..... 704/205
7,318,026 B2 * 1/2008 Inokuchi ..... 704/229
7,613,604 B1 * 11/2009 Malah et al. ..... 704/205
7,801,733 B2 * 9/2010 Lee et al. ..... 704/500
8,032,359 B2 * 10/2011 Shlomot et al. ..... 704/201
8,069,038 B2 * 11/2011 Malah et al. ..... 704/205
8,069,040 B2 * 11/2011 Vos ..... 704/222
8,078,474 B2 * 12/2011 Vos et al. ..... 704/500
8,135,047 B2 * 3/2012 Rajendran et al. ..... 370/536
8,140,324 B2 * 3/2012 Vos et al. ..... 704/225
8,195,450 B2 * 6/2012 Shlomot et al. ..... 704/201
2002/0141440 A1 * 10/2002 Stanley et al. ..... 370/465
2003/0093278 A1 * 5/2003 Malah ..... 704/265
2003/0093279 A1 * 5/2003 Malah et al. ..... 704/265
2003/0128292 A1 7/2003 Kitamura et al.
2004/0264567 A1 12/2004 Xu et al.
2005/0004793 A1 * 1/2005 Ojala et al. ..... 704/219
2005/0053132 A1 3/2005 Caball et al.

(Continued)

FOREIGN PATENT DOCUMENTS

EP 1 808 684 A1 7/2007

*Primary Examiner* — Justin Rider
(74) *Attorney, Agent, or Firm* — Jefferson IP Law, LLP

(57) ABSTRACT

An apparatus and method for encoding and decoding using mutual information between a high band signal and a low band signal to increase a coding efficiency in a portable terminal are provided. The apparatus includes a bandwidth extender for extracting auxiliary information relating to a characteristic of a high band signal using the high band signal and a low band signal and an encoder for encoding residual high band signal obtained by subtracting auxiliary information acquired from the low band signal from auxiliary information acquired from the high band signal.

16 Claims, 19 Drawing Sheets

U.S. PATENT DOCUMENTS

2005/0187759 A1* 8/2005 Malah et al. ..... 704/200
2006/0122828 A1* 6/2006 Lee et al. ..... 704/219
2006/0149538 A1* 7/2006 Lee et al. ..... 704/219
2006/0277038 A1* 12/2006 Vos et al. ..... 704/219
2006/0277039 A1* 12/2006 Vos et al. ..... 704/219
2006/0277042 A1* 12/2006 Vos et al. ..... 704/223
2006/0282262 A1* 12/2006 Vos et al. ..... 704/219
2006/0282263 A1* 12/2006 Vos et al. ..... 704/223
2007/0040709 A1* 2/2007 Sung et al. ..... 341/50
2007/0088541 A1* 4/2007 Vos et al. ..... 704/219
2007/0088542 A1* 4/2007 Vos et al. ..... 704/219
2007/0088558 A1* 4/2007 Vos et al. ..... 704/275
2007/0154225 A1* 7/2007 Schulz et al. ..... 398/202
2008/0027711 A1* 1/2008 Rajendran et al. ..... 704/201
2008/0027718 A1* 1/2008 Krishnan et al. ..... 704/211
2008/0043835 A1 2/2008 Sasai et al.
2008/0095259 A1* 4/2008 Dyer et al. ..... 375/265
2008/0126086 A1* 5/2008 Vos et al. ..... 704/225
2008/0195383 A1* 8/2008 Shlomot et al. ..... 704/205
2009/0144062 A1* 6/2009 Ramabadran et al. ..... 704/500
2009/0198498 A1* 8/2009 Ramabadran et al. ..... 704/500
2009/0201983 A1* 8/2009 Jasiuk et al. ..... 375/240
2009/0240509 A1* 9/2009 Song et al. ..... 704/500
2010/0042408 A1* 2/2010 Malah et al. ..... 704/205
2011/0112844 A1* 5/2011 Jasiuk et al. ..... 704/500
2011/0112845 A1* 5/2011 Jasiuk et al. ..... 704/500
2011/0280337 A1* 11/2011 Lee et al. ..... 375/295

* cited by examiner

APPARATUS AND METHOD FOR ENCODING AND DECODING USING BANDWIDTH EXTENSION IN PORTABLE TERMINAL

PRIORITY

This application claims the benefit under 35 U.S.C. §119 (a) of a Korean patent application filed in the Korean Intellectual Property Office on Mar. 20, 2008 and assigned Serial No. 10-2008-0025980 and a Korean patent application filed in the Korean Intellectual Property Office on Mar. 21, 2008 and assigned Serial No. 10-2008-0026340 the entire disclosure of both of which are hereby incorporated by reference.

BACKGROUND OF THE INVENTION

1. Field of the Invention

The present invention relates generally to an apparatus and a method for encoding and decoding in a portable terminal. More particularly, the present invention relates to an apparatus and a method for enhancing a coding efficiency in a portable terminal which adopts a bandwidth extension.

2. Description of the Related Art

With advances in digital signal processing technology, audio signals are typically stored and reproduced as digital data. A digital audio storing/reproducing apparatus samples and quantizes an analog audio signal, converts the analog signal into a digital audio data using Pulse Code Modulation (PCM), and stores the digital data to an information storage medium such as Compact Disc (CD) or Digital Versatile Disc (DVD). Because the data is conveniently stored, a user may reproduce the audio data on demand.

In comparison to other methods, the digital method provides an enhanced sound quality. For example, compared to a method which estimates and restores a high band signal from a low band signal or a feature vector extracted from the low band signal that reproduces only the low band signal at the receiver using an artificial BandWidth Extension (BWE), the sound quality of the digital method is enhanced.

As an example of a receiver using BWE, provided that a sampling frequency Fs of an input signal is 16 kHz, the bandwidth extension restores the high band signal of 4 k~8 kHz from the low band signal of 0~4 kHz and produces the same signal 16 kHz as the original input signal. The success of the bandwidth extension is closely related with a correlation between the frequency bands (the high band and the low band) of the input signal.

When the input signal of one frame is divided into the low band and the high band based on the frequency band, the signals of the two bands have a close correlation because they are generated from the same source. If the correlation or mutual information between the two bands is considerable, the high band signal recovered through the bandwidth extension exhibits sound quality that is close to the original sound.

However, when there is only a small amount of information relating to the high band signal because of a low correlation between the two bands, the bandwidth extension cannot adequately restore the high band signal.

Accordingly, there is a need for an improved apparatus and a method for enhancing performance of a coding apparatus using a bandwidth extension in a portable terminal.

SUMMARY OF THE INVENTION

An aspect of the present invention is to address at least the above mentioned problems and/or disadvantages and to provide at least the advantages described below. Accordingly, an aspect of the present invention is to provide an apparatus and a method for enhancing a performance of the coding apparatus using a BandWidth Extension (BWE) in a portable terminal.

Another aspect of the present invention is to provide an apparatus and a method for coding by removing high band information overlapping with a low band signal in the coding apparatus using a BWE in a portable terminal.

Yet another aspect of the present invention is to provide an apparatus and a method for coding by removing a correlation between frames in the coding apparatus using a BWE in a portable terminal.

According to an aspect of the present invention, a coding apparatus using band extension is provided. The apparatus includes a bandwidth extender for extracting auxiliary information relating to a characteristic of a high band signal using the high band signal and a low band signal and an encoder for encoding a residual high band signal obtained by subtracting auxiliary information acquired from the low band signal from auxiliary information acquired from the high band signal.

According to another aspect of the present invention, a coding method is provided. The method includes extracting auxiliary information relating to a characteristic of a high band signal using the high band signal and a low band signal, subtracting auxiliary information acquired from the low band signal from auxiliary information acquired from the high band signal, and encoding the subtracted residual high band signal.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments the present invention will be more apparent from the following description taken in conjunction with the accompanying drawings, in which.

DETAILED DESCRIPTION OF EXEMPLARY EMBODIMENTS

The following description with reference to the accompanying drawings is provided to assist in a comprehensive understanding of exemplary embodiments of the present invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

Exemplary embodiments of the present invention provide an apparatus and a method for enhancing a coding performance in a portable terminal using a bandwidth extension.

Figure 1:
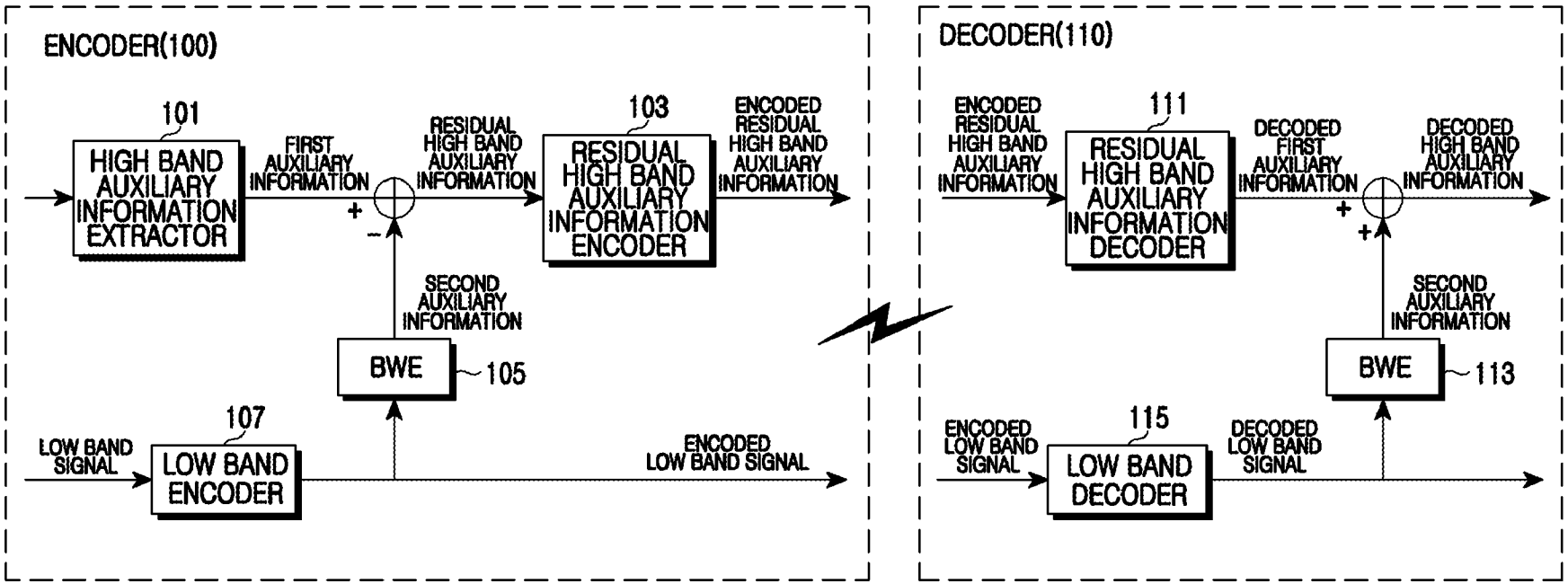
FIG. 1 is a block diagram of a coding apparatus according to an exemplary embodiment of the present invention.

FIG. 1 is a block diagram of a coding apparatus according to an exemplary embodiment of the present invention.

An exemplary coding apparatus of the present invention extracts and codes information relating to a characteristic of a high band signal and prevents redundancy of high band information using a low band signal. The coding apparatus includes an encoder 100 and a decoder 110.

The coding apparatus extracts auxiliary information relating to the characteristic of the high band signal using the high band signal and the low band signal. The coding apparatus also controls to encode residual high band auxiliary information generated by subtracting the auxiliary information extracted using the low band signal from the auxiliary information extracted using the high band signal at a subtractor.

When receiving the residual high band auxiliary information, the coding apparatus decodes the received auxiliary information and confirms the high band auxiliary information using the decoded low band signal. Next, the coding apparatus controls an adder to add the confirmed auxiliary information and output the original high band signal.

While the overall operation of the coding apparatus has been described above, the operations of the coding apparatus are explained in further detail below.

Referring to FIG. 1, the encoder 100 of the coding apparatus includes a high band auxiliary information extractor 101, a residual high band auxiliary information encoder 103, a bandwidth extender 105, and a low band encoder 107.

The high band auxiliary information extractor 101 extracts auxiliary information which relates to the characteristic of the high band signal to produce the original input signal using a correlation between the high band and the low band. Herein, the auxiliary information represents the characteristic of the high band signal, such as a Linear Prediction Coefficient (LPC) representing the shape of the envelope of the high band frequency, a Mel-Frequency Cepstral Coefficient (MFCC) of a similar type, energy of the high band and the like.

The low band encoder 107 encodes the low band signal of the signal input through a band pass filter (not shown) and provides the encoded low band signal to the bandwidth extender 105.

The bandwidth extender 105 receives the low band signal encoded by the low band encoder 107 and estimates high band auxiliary information.

The residual high band auxiliary information encoder 103 encodes residual high band auxiliary information which includes auxiliary information of the high band, from which the subtractor of the coding apparatus subtracts the auxiliary information extracted using the low band signal. Herein, the residual high band auxiliary information indicates auxiliary information from which a redundant part of the auxiliary information extracted using the low band is eliminated when the high band auxiliary information is encoded, to prevent the redundant encoding of the partial information of the high band estimated from the low band information when the auxiliary information is extracted and encoded in the low band and the high band according to the general bandwidth extension.

The decoder 110 of the coding apparatus extracts high band auxiliary information by decoding the encoded residual high band auxiliary information and the encoded low band auxiliary information, adds the extracted auxiliary information, and outputs a reproduction of the original high band signal. The decoder 110 includes an auxiliary information decoder 111, a bandwidth extender 113, and a low band decoder 115.

The low band decoder 115 reproduces the low band signal by decoding the encoded low band information received over a communication channel.

The bandwidth extender 113 estimates high band auxiliary information using the low band signal decoded by the low band decoder 115. The auxiliary information decoder 111 generates residual high band auxiliary information by decoding the encoded residual high band auxiliary information.

Figure 2:
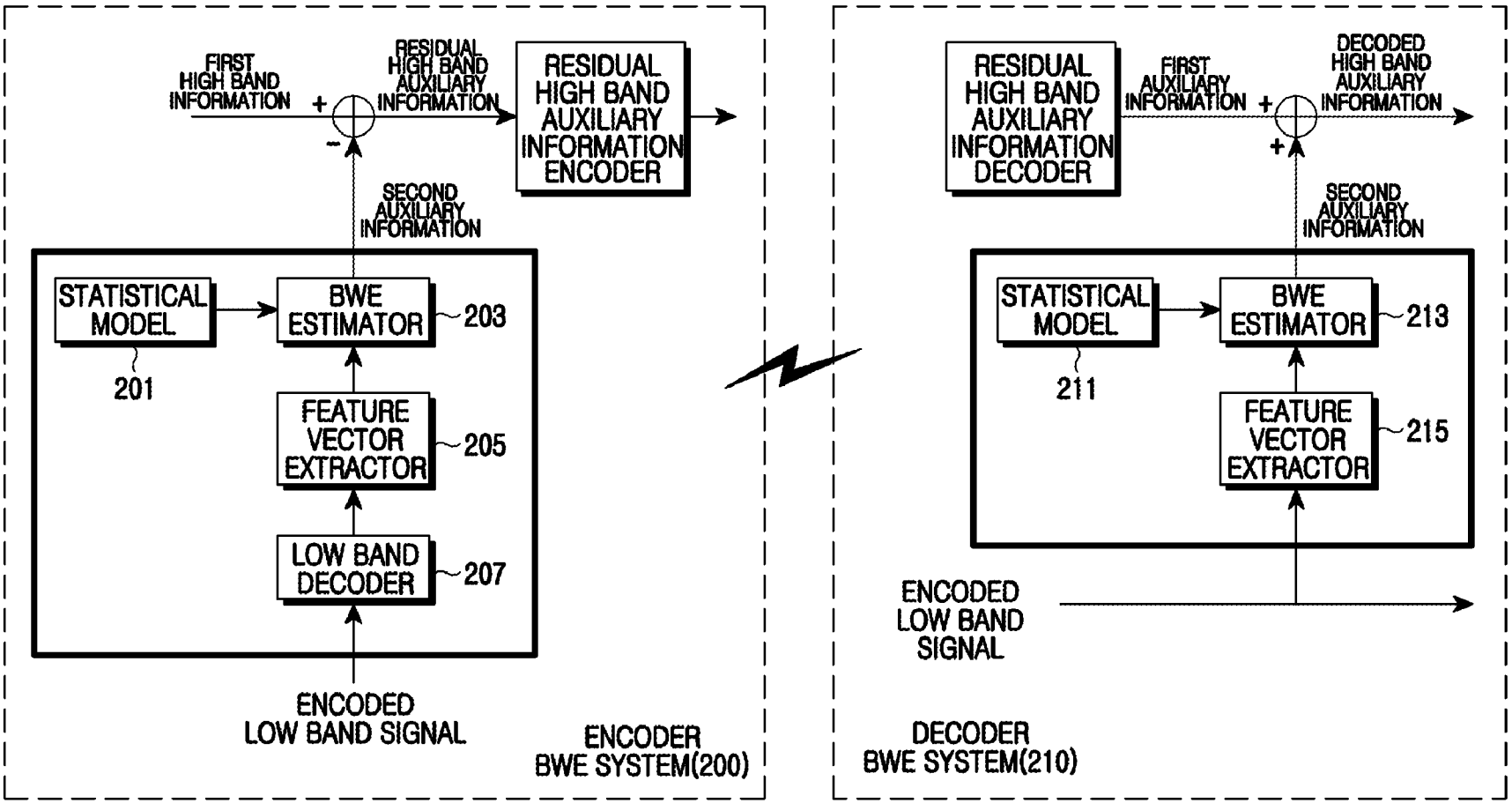
FIG. 2 is a block diagram of a bandwidth extender of a coding apparatus according to an exemplary embodiment of the present invention.

FIG. 2 is a block diagram of a bandwidth extender of a coding apparatus according to an exemplary embodiment of the present invention.

The bandwidth extender of FIG. 2 includes a bandwidth extender 200 of the encoder and a bandwidth extender 210 of the decoder.

The bandwidth extender 200 of the encoder extracts the auxiliary information of the high band using the encoded low band signal. The bandwidth extender 200 includes a statistical model 201, a BandWidth Extension (BWE) estimator 203, a feature vector extractor 205, and a low band decoder 207.

The bandwidth extender 200 of the encoder decodes the encoded low band signal using the low band decoder 207 and applies the decoded low band signal to the feature vector extractor 205. The feature vector extractor 205 generates a feature vector of the input low band signal and provides the generated feature vector to the BWE estimator 203.

The BWE estimator 203 estimates high band auxiliary information using the input low band feature vector and the statistical model 201 and outputs the estimated high band auxiliary information. Herein, the statistical model 201 may include preset information used for the BWE estimation.

In an exemplary implementation in which the high band auxiliary information is in a scalar form, the estimated high band auxiliary information and the residual high band auxiliary information are in the scalar form as well. Accordingly, the residual high band auxiliary information encoder employs a Scalar Quantizer (SQ). In a case of the vector type, the residual high band auxiliary information encoder employs a Vector Quantizer (VQ).

The encoder generates the residual high band auxiliary information by subtracting the auxiliary information estimated by the bandwidth extender 200 from the auxiliary information extracted using the high band signal.

The bandwidth extender 210 of the decoder estimates the high band auxiliary information from the input low band signal. The bandwidth extender 210 includes a statistical model 211, a BWE estimator 213, and a feature vector extractor 215, which are substantially the same as those in the bandwidth extender 200 of the encoder.

The bandwidth extender 210 of the decoder inputs the low band signal to the feature vector extractor 215. The feature vector extractor 215 generates a feature vector of the input low band signal and applies the feature vector to the BWE estimator 213.

The BWE estimator 213 estimates the high band auxiliary information using the input low band feature vector and the statistical model 211 and outputs the estimated high band auxiliary information. Herein, the statistical model 211 may include preset information required for the BWE estimation.

Figure 3:
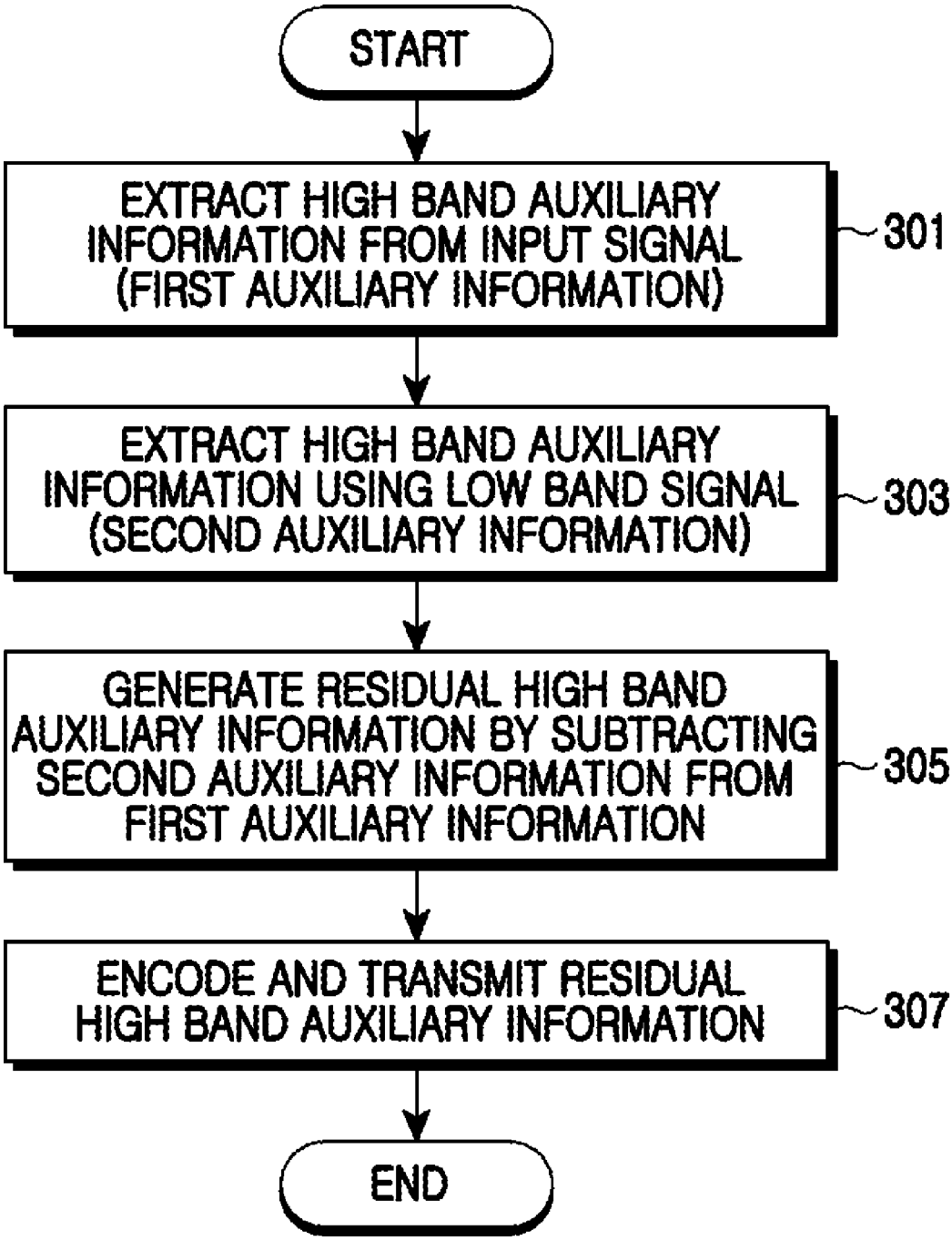
FIG. 3 is a flowchart of a method for increasing coding efficiency using auxiliary information indicative of a characteristic of a high band signal at an encoder according to an exemplary embodiment of the present invention.

FIG. 3 is a flowchart of a method for increasing coding efficiency using auxiliary information indicative of a characteristic of a high band signal at an encoder according to an exemplary embodiment of the present invention.

After extracting high band auxiliary information (hereafter, referred to as first auxiliary information) from the input signal in step 301, the encoder processes to extract the high band auxiliary information (hereafter, referred to as second auxiliary information) using the low band signal in step 303. Herein, the high band auxiliary information relates to the characteristic of the high band signal to produce the original input signal using the correlation between the high band and the low band, such as LPC representing the shape of the envelope of the high band frequency, MFCC of the similar type, energy of the high band and the like.

After generating the residual high band auxiliary information by subtracting the second auxiliary information from the first auxiliary information in step 305, the encoder processes to encode and transmit the generated residual high band auxiliary information in step 307. Herein, the residual high band auxiliary information is produced by removing the second auxiliary information from the input high band auxiliary information.

Next, the encoder finishes this process.

Figure 4:
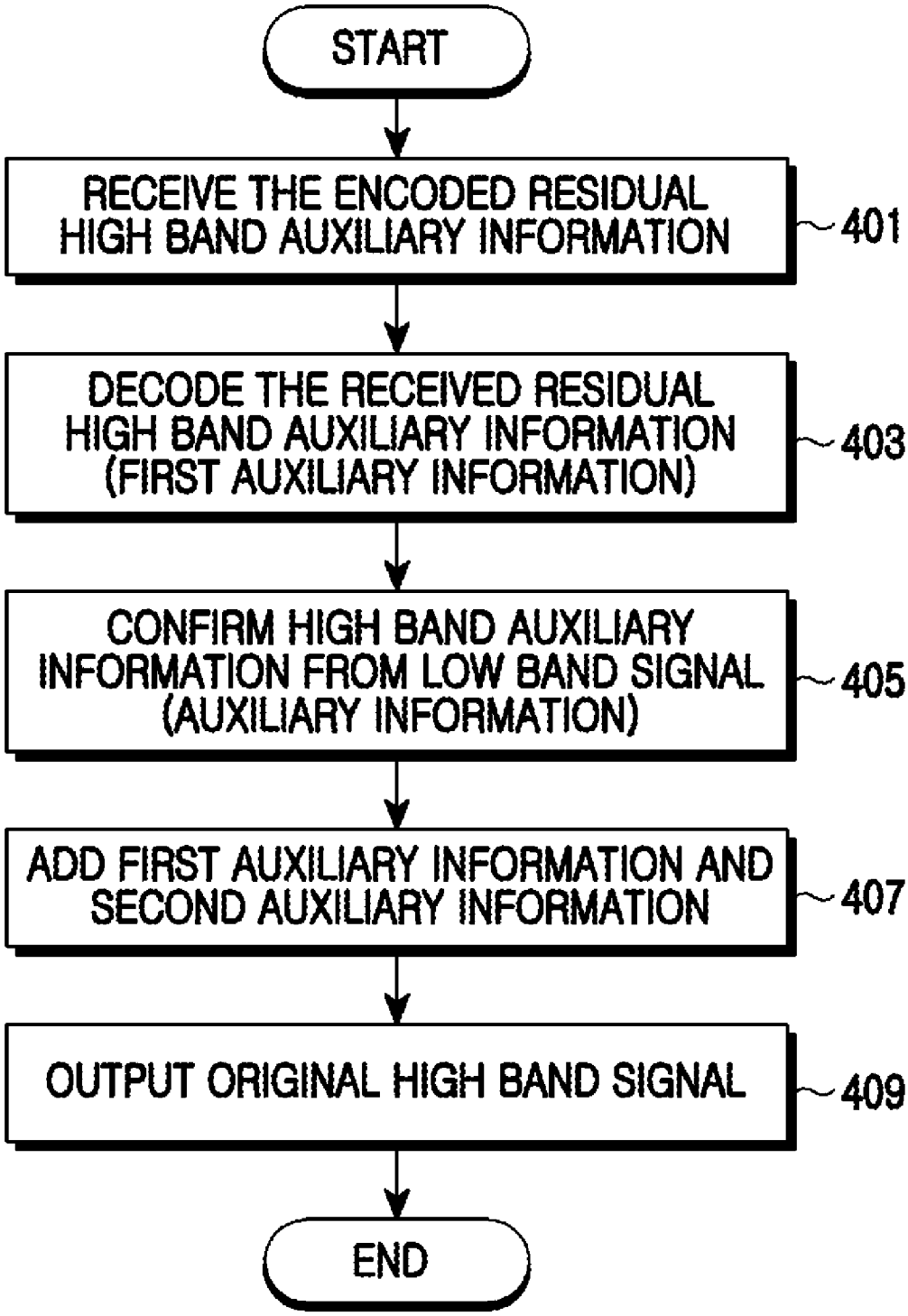
FIG. 4 is a flowchart of a method for increasing coding efficiency using auxiliary information indicative of a characteristic of a high band signal at a decoder according to an exemplary embodiment of the present invention.

FIG. 4 is a flowchart of a method for increasing coding efficiency using auxiliary information indicative of a characteristic of a high band signal at a decoder according to an exemplary embodiment of the present invention.

In the following description, it is assumed that the decoder decodes and outputs the low band signal received from an encoder.

After receiving the encoded residual high band signal from the encoder in step 401, the decoder generates first auxiliary information by decoding the received residual high band signal in step 403.

In step 405, the decoder confirms the high band information (hereafter, referred to as second auxiliary information) from the low band signal.

After adding the first auxiliary information and the second auxiliary information in step 407, the decoder produces the original high band signal using the added high band information in step 409 and then finishes this process.

Figure 5:
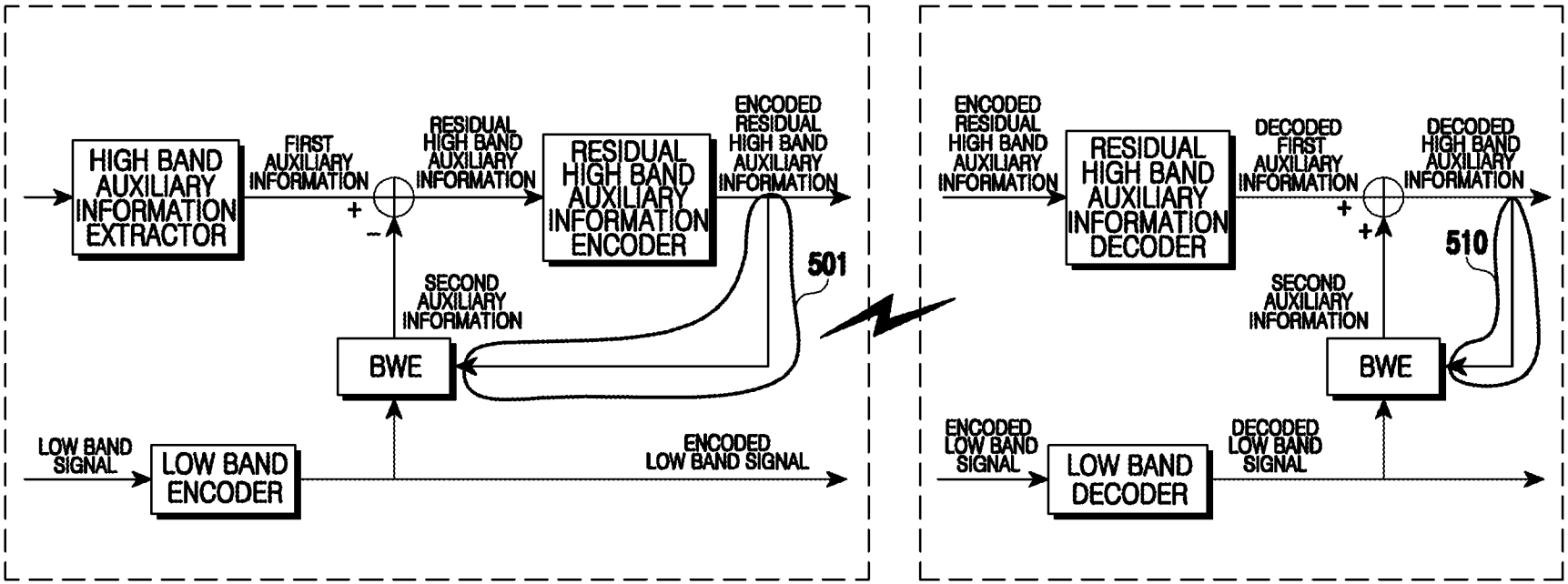
FIG. 5 is a block diagram of a coding apparatus according to an exemplary embodiment of the present invention.

FIG. 5 is a block diagram of a coding apparatus according to an exemplary embodiment of the present invention.

The coding apparatus of FIG. 5 prevents redundancy of the high band information using the low band signal by extracting and encoding the information relating to the characteristic of the high band signal as described in FIG. 1. For estimating the high band auxiliary information, the coding apparatus feeds back and utilizes not only the low band signal but also the past pre-encoded high band auxiliary information.

Referring to FIG. 5, the coding apparatus extracts the auxiliary information relating to the characteristic of the high band signal by use of the high band signal and the low band signal. The coding apparatus extracts the auxiliary information by feeding back the past pre-encoded high band auxiliary information 501.

The coding apparatus encodes the residual high band auxiliary information generated by subtracting the auxiliary information extracted using the low band signal from the auxiliary information extracted using the high band signal.

When receiving the residual high band auxiliary information, the coding apparatus decodes the received auxiliary information and confirms the high band auxiliary information using the decoded low band signal. In so doing, the coding apparatus processes to output the original high band signal using not only the low band signal but also the auxiliary information 510 using the fed back high band auxiliary information.

While the overall operation of the coding apparatus has been described above, it is described in further detail below.

An exemplary encoder of the coding apparatus may include a high band auxiliary information extractor, a residual high band auxiliary information encoder, a bandwidth extender, and a low band decoder as mentioned in FIG. 1. The high band auxiliary information extractor, the residual high band auxiliary information encoder, and the low band encoder operate substantially the same as in FIG. 1 and therefore shall not be further explained.

The bandwidth extender extracts the auxiliary information by feeding back the low band signal encoded by the low band encoder and the past pre-encoded high band auxiliary information.

The encoder processes to encode the residual high band auxiliary information which is the auxiliary information of the high band obtained by subtracting the auxiliary information extracted using the low band signal and the pre-encoded high band auxiliary information at the subtractor of the coding apparatus.

The decoder of the coding apparatus extracts the high band auxiliary information by decoding the encoded residual high band auxiliary information and the encoded low band auxiliary information, adds the extracted auxiliary information, and thus produces the original high band signal. The decoding can include an auxiliary information decoder, a bandwidth extender, and a low band decoder.

The low band decoder reproduces the low band signal by decoding the encoded low band information received over the communication channel.

The bandwidth extender estimates the high band auxiliary information using the low band signal decoded by the low band decoder and the fed back high band auxiliary information. The auxiliary information decoder generates the residual high band auxiliary information by decoding the encoded residual high band auxiliary information.

FIG. 6 includes graphs illustrating performance of a coding apparatus according to an exemplary embodiment of the present invention.

In FIG. 6, performance of the coding apparatus is determined by the mutual information between the low band signal and the high band signal.

The mutual information between the low band signal and the high band signal can be acquired based on Equation (1).

$$I(X;Y)=\int_{\Omega_y}\int_{\Omega_x} f_{XY}(X,Y)\log_2\left(\frac{f_{XY}(X,Y)}{f_X(X)f_y(Y)}\right)dxdy \quad (1)$$

In Equation (1), X denotes a feature vector of the low band signal and Y denotes a feature vector of the high band signal. $f_X(x)$ denotes a probability density function of X, $f_Y(y)$ denotes a probability density function of Y, and $f_{XY}(x, y)$ denotes a joint probability density function of X and Y.

In an exemplary implementation, the coding apparatus uses the $10^{th}$ order MFCC. That is, X={X1, . . . , X10} as the feature vector for the low band signal and uses the $8^{th}$ order MFCC, that is, Y={Y1, . . . , Y8} as the feature vector for the high band signal. Instead of the MFCC, another feature vector, such as LPC, can be selected in various applications.

The coding apparatus can define the mutual information between the components of the low band vector X and the high band vector Y as shown in Table 1, and define the mutual information between sub-vectors of the low band vector X and the high band vector Y as shown in Table 2.

TABLE 1

| [X; Y component] | MI (bit) |
|---|---|
| [X; Y1] | 1.214624121 |
| [X; Y2] | 0.442184563 |
| [X; Y3] | 0.403603817 |
| [X; Y4] | 0.301242604 |
| [X; Y5] | 0.197981724 |
| [X; Y6] | 0.160667332 |
| [X; Y7] | 0.150365385 |
| [X; Y8] | 0.124140187 |

TABLE 2

| [X; Y sub-vector] | MI (bit) |
|---|---|
| [X; Y1] | 1.214624121 |
| [X; Y1, Y2] | 1.553642011 |
| [X; Y1, . . . , Y3] | 1.863667033 |
| [X; Y1, . . . , Y4] | 2.078319061 |
| [X; Y1, . . . , Y5] | 2.21684601 |
| [X; Y1, . . . , Y6] | 2.340196486 |
| [X; Y1, . . . , Y7] | 2.437012574 |
| [X; Y] | 2.513291974 |

Figure 6A:
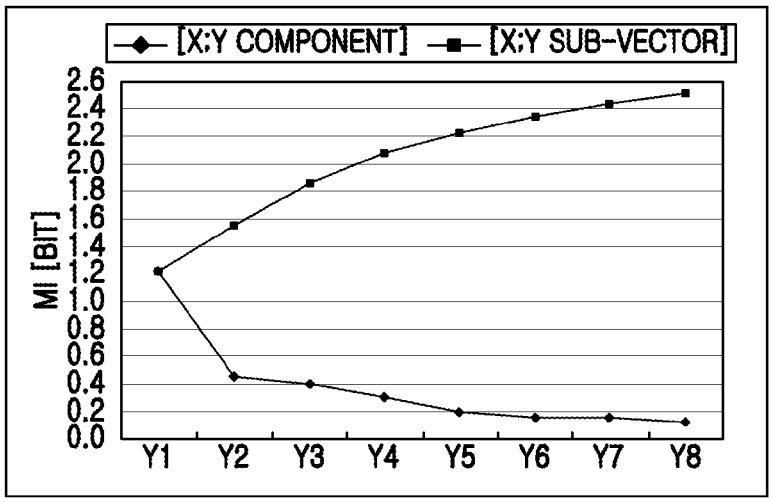
FIG. 6A is a graph of mutual information between the low band signal and the high band signal.

FIG. 6A is a graph of mutual information between the low band signal and the high band signal.

The mutual information can be represented as shown in FIG. 6A. When a coding apparatus according to an exemplary embodiment of the present invention encodes the high band $8^{th}$ order MFCC as shown in FIG. 6A, the scalar quantization can exhibit coding efficiency of about 4.5 bits (the sum of the second column of Table 1) per frame and the vector quantization can exhibit coding efficiency of about 2.5 bits (the MI value of [X; Y] of Table 2) per frame. Given the frame size of 20 ms, those bit efficiencies per frame correspond to 225 bits and 125 bits per second.

The coding apparatus may achieve the coding performance as shown in Table 3 and Table 4.

TABLE 3

| Quantization bits | BWE + SQ (CD value) | SQ (CD value) |
|---|---|---|
| 0 | 0.22716 | 0.998309 |
| 1 | 0.103151 | 0.332132 |
| 2 | 0.036519 | 0.085834 |
| 3 | 0.011267 | 0.022771 |
| 4 | 0.003119 | 0.006094 |
| 5 | 0.000827 | 0.001615 |
| 6 | 0.000213 | 0.000419 |
| 7 | 5.4E−05 | 0.000107 |
| 8 | 1.34E−05 | 2.72E−05 |

CD denotes the Cepstral Distance value.

TABLE 4

| Quantization bits | BWE + VQ (CD value) | VQ (CD value) |
|---|---|---|
| 0 | 0.759873 | 1.000935 |
| 1 | 0.692462 | 0.886891 |
| 2 | 0.608997 | 0.766667 |
| 3 | 0.528997 | 0.651902 |
| 4 | 0.453339 | 0.55646 |
| 5 | 0.389293 | 0.472844 |
| 6 | 0.33218 | 0.400793 |
| 7 | 0.283245 | 0.34054 |
| 8 | 0.24111 | 0.288309 |

CD denotes the Cepstral Distance value.

Table 3 compares the coding efficiency obtained by the method for coding the high band vector component Y1 using the SQ and the method for coding the high band vector component Y1 using the BWE based coder (BWE+SQ). Table 4 compares the coding efficiency obtained by the method for coding the high band vector Y using the VQ and the method for coding the high band vector Y using the BWE based coder (BWE+VQ). The coding efficiency of the coding apparatus is shown in FIGS. 6B and 6C.

Figure 6B:
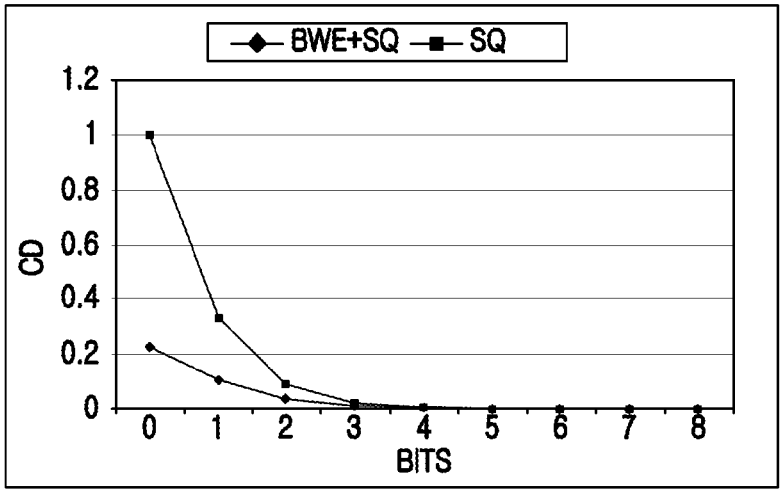
FIG. 6B is a graph of coding efficiency of the coding apparatus using BandWidth Extension and Scaler Quantizer (BWE+SQ)
Figure 6C:
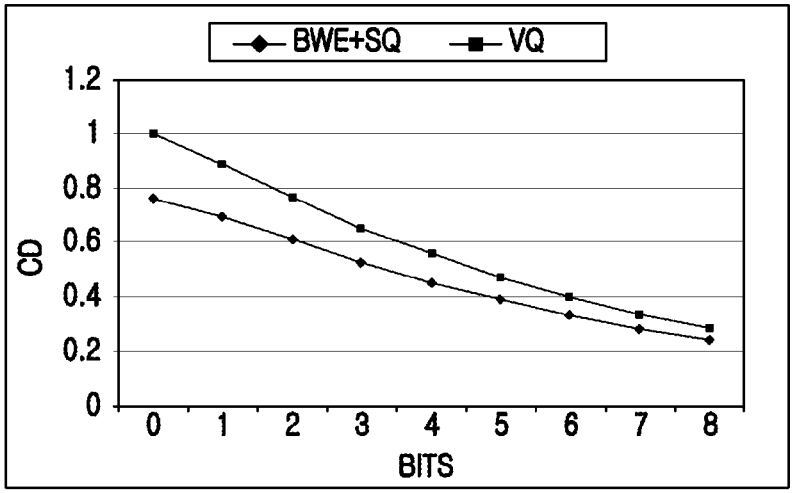
FIG. 6C is a graph of coding efficiency of the coding apparatus using BandWidth Extension and Vector Quantizer (BWE+VQ)

FIG. 6B is a graph of coding efficiency of the coding apparatus using (BWE+SQ) and FIG. 6C is a graph of coding efficiency of the coding apparatus using (BWE+VQ).

In FIGS. 6B and 6C, the efficiency is notable in the coding at low bits. The scalar quantization increases the coding efficiency by about 1.5 bits per frame at maximum and the vector quantization increases the coding efficiency by about 2 bits per frame at maximum.

Figure 7:
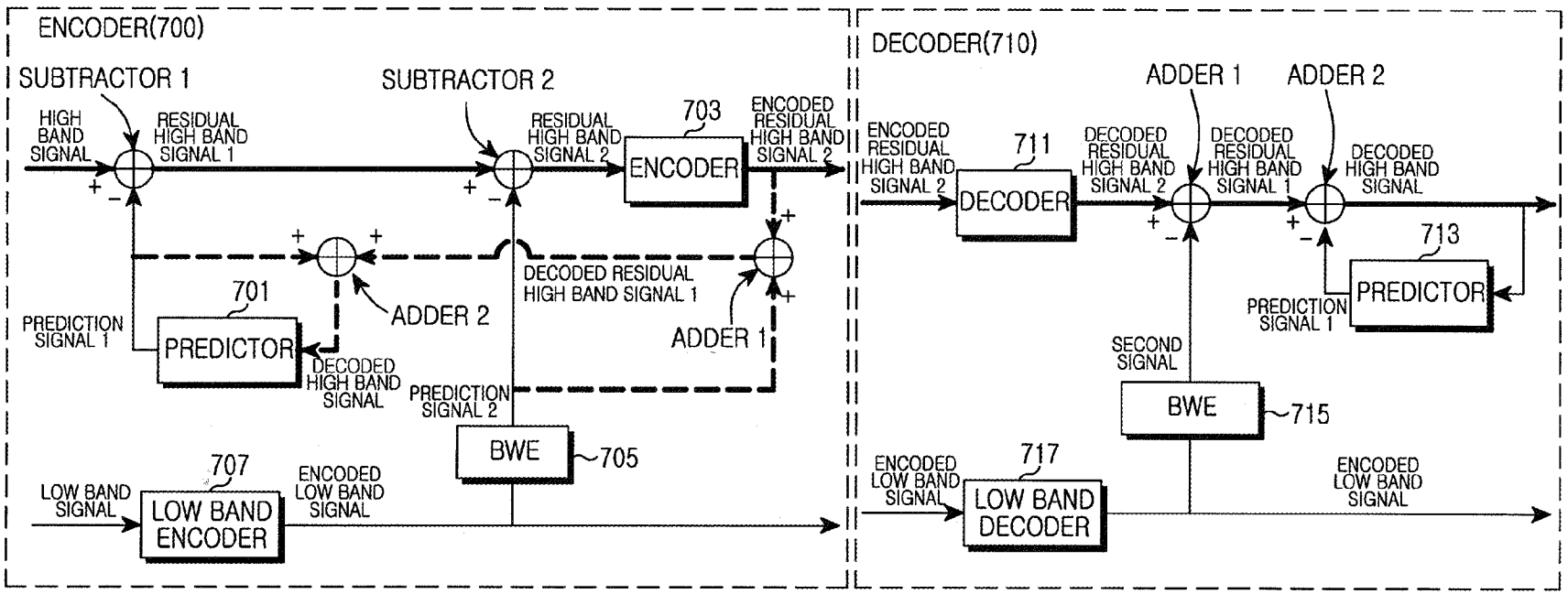
FIG. 7 is a block diagram of a coding apparatus according to an exemplary embodiment of the present invention.

FIG. 7 is a block diagram of a coding apparatus according to an exemplary embodiment of the present invention.

The coding apparatus of FIG. 7 enhances the coding performance using prediction information which predicts the signal of the high band. The coding apparatus includes an encoder 700 and a decoder 710.

The coding apparatus predicts the high band signal using the pre-decoded high band signal and generates the residual high band signal by subtracting the predicted high band signal (the correlation between the frames) from the input high band signal. Next, the encoder predicts the high band signal (the correlation in the frame) using the encoded low band signal and processes to encode the signal by subtracting the predicted high band signal from the residual high band signal.

The decoder corresponding to the encoder decodes the received signal and confirms the high band signal using the decoded low band signal. Next, the coding apparatus processes to produce the original high band signal by adding the confirmed high band signals.

While the overall operation of the coding apparatus has been described, more detailed descriptions on the coding apparatus are now provided.

Referring to FIG. 7, the encoder 700 of the coding apparatus includes a predictor 701, an encoder 703, a bandwidth extender 705, and a low band encoder 707.

The predictor 701 of the encoder 700 estimates the high band signal using the pre-decoded high band signal.

The low band encoder 707 encodes the low band signal of the input signal and provides the encoded low band signal to the bandwidth extender 705.

The bandwidth extender 705 receives the low band signal encoded by the low band encoder 707 and estimates the high band signal.

The encoder 703 encodes the residual high band signal which is the high band signal from which subtractors of the coding apparatus subtract the high band signal estimated using the low band signal.

The decoder 710 of the coding apparatus includes a decoder 711, a predictor 713, a bandwidth extender 715 and a low band decoder 717.

Figure 8:
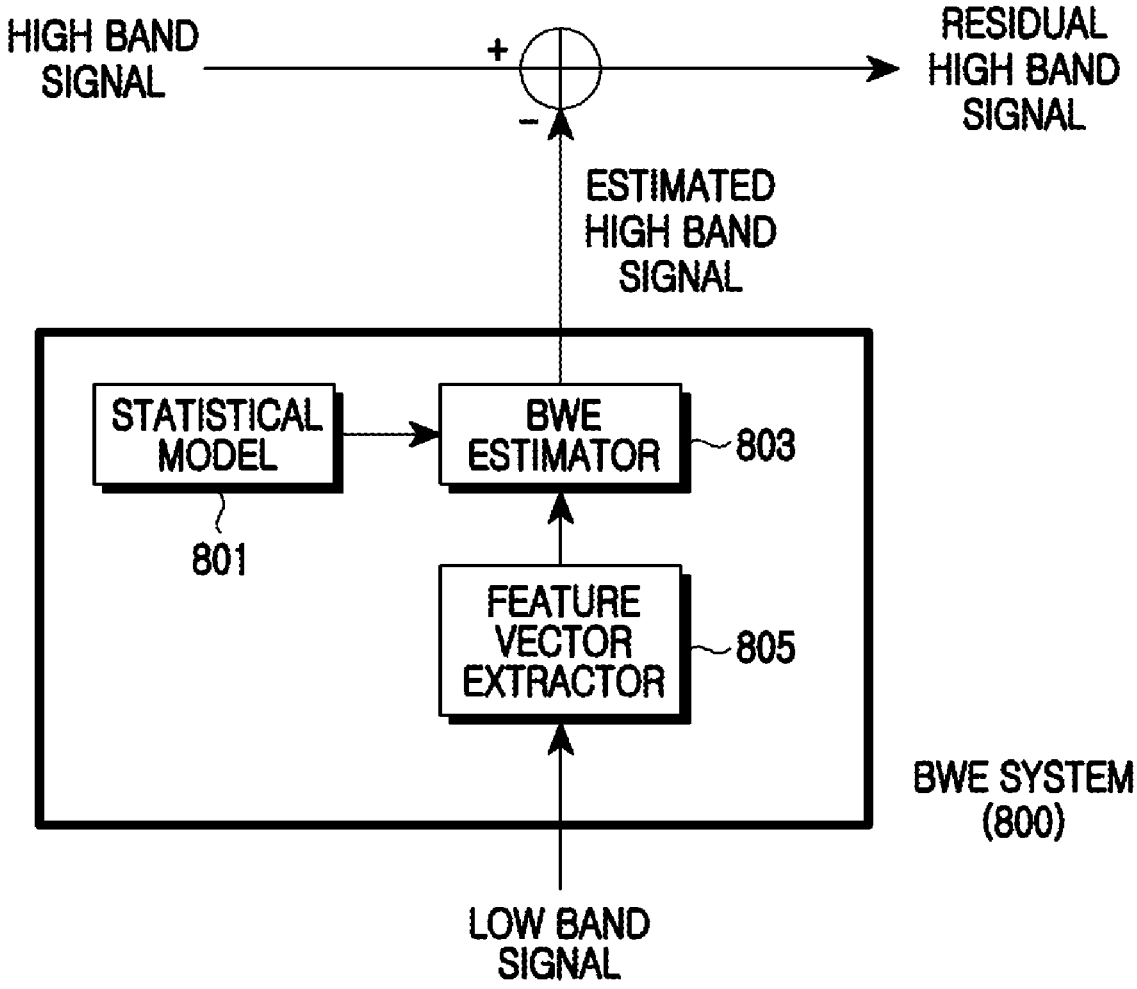
FIG. 8 is a block diagram of a bandwidth extender of a coding apparatus according to an exemplary embodiment of the present invention.

FIG. 8 is a block diagram of a bandwidth extender of a coding apparatus according to an exemplary embodiment of the present invention.

The bandwidth extender 800 of the coding apparatus in FIG. 8 estimates the auxiliary information of the high band using the encoded low band signal. The bandwidth extender 800 includes a statistical model 801, a BWE estimator 803, and a feature vector extractor 805.

In the bandwidth extender 800, the input low band signal is fed to the feature vector extractor 805. The feature vector extractor 805 generates a feature vector of the input low band signal and provides the feature vector to the BWE estimator 803. The BWE estimator 803 outputs the estimated high band signal using the statistical model 801 pre-learned and required for the BWE estimation and the input low band feature vector.

Figure 9:
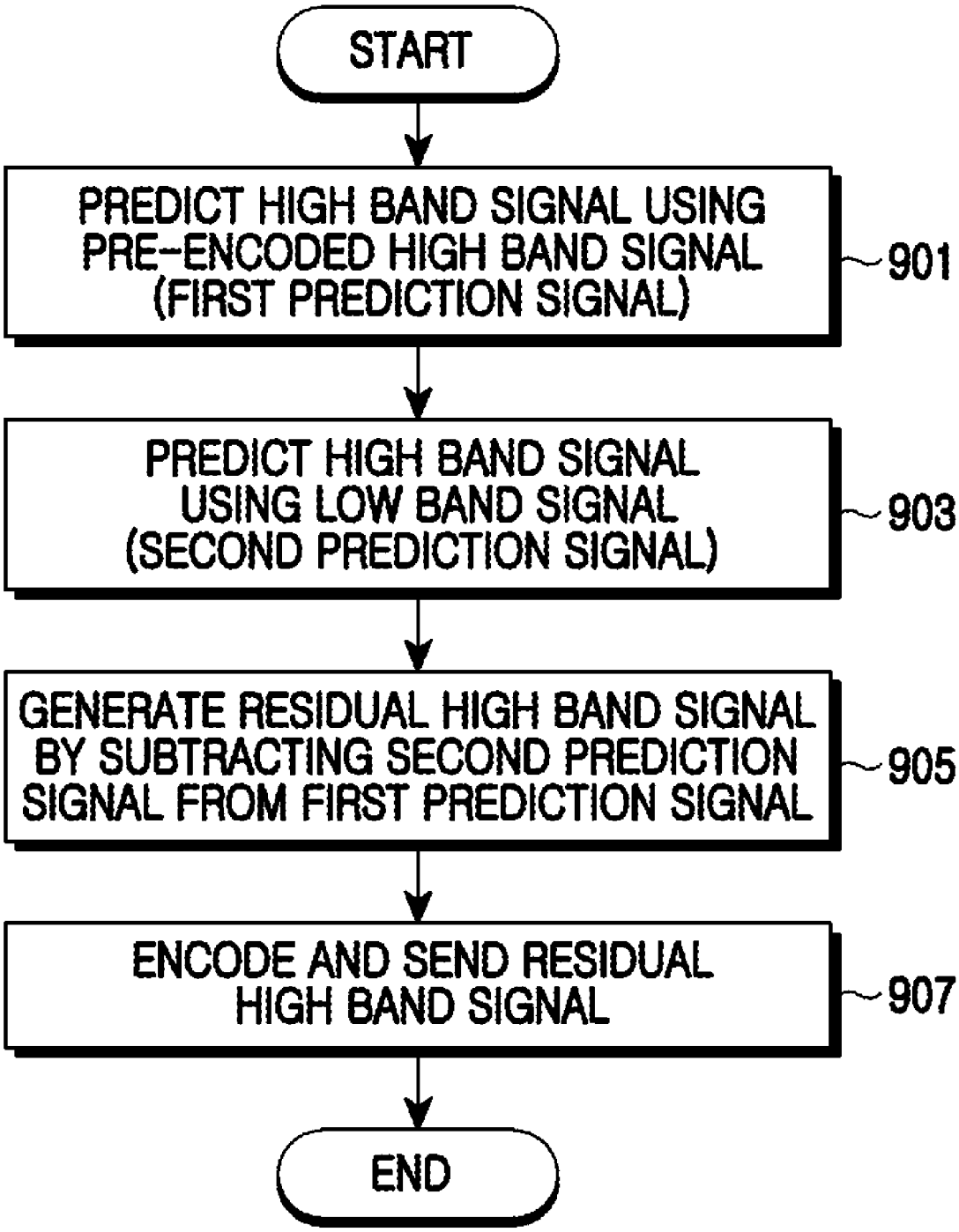
FIG. 9 is a flowchart for increasing coding efficiency by predicting a high band signal at an encoder according to an exemplary embodiment of the present invention.

FIG. 9 is a flowchart for increasing coding efficiency by predicting a high band signal at an encoder according to an exemplary embodiment of the present invention.

After predicting the high band signal (referred to as a first prediction signal) using the pre-encoded high band signal in step 901, the encoder predicts the high band signal (referred to as a second prediction signal) using the low band signal in step 903.

The encoder generates the residual high band signal by subtracting the second prediction signal from the first prediction signal in step 905, and encodes and transmits the generated residual band signal in step 907.

Next, the encoder finishes this process.

Figure 10:
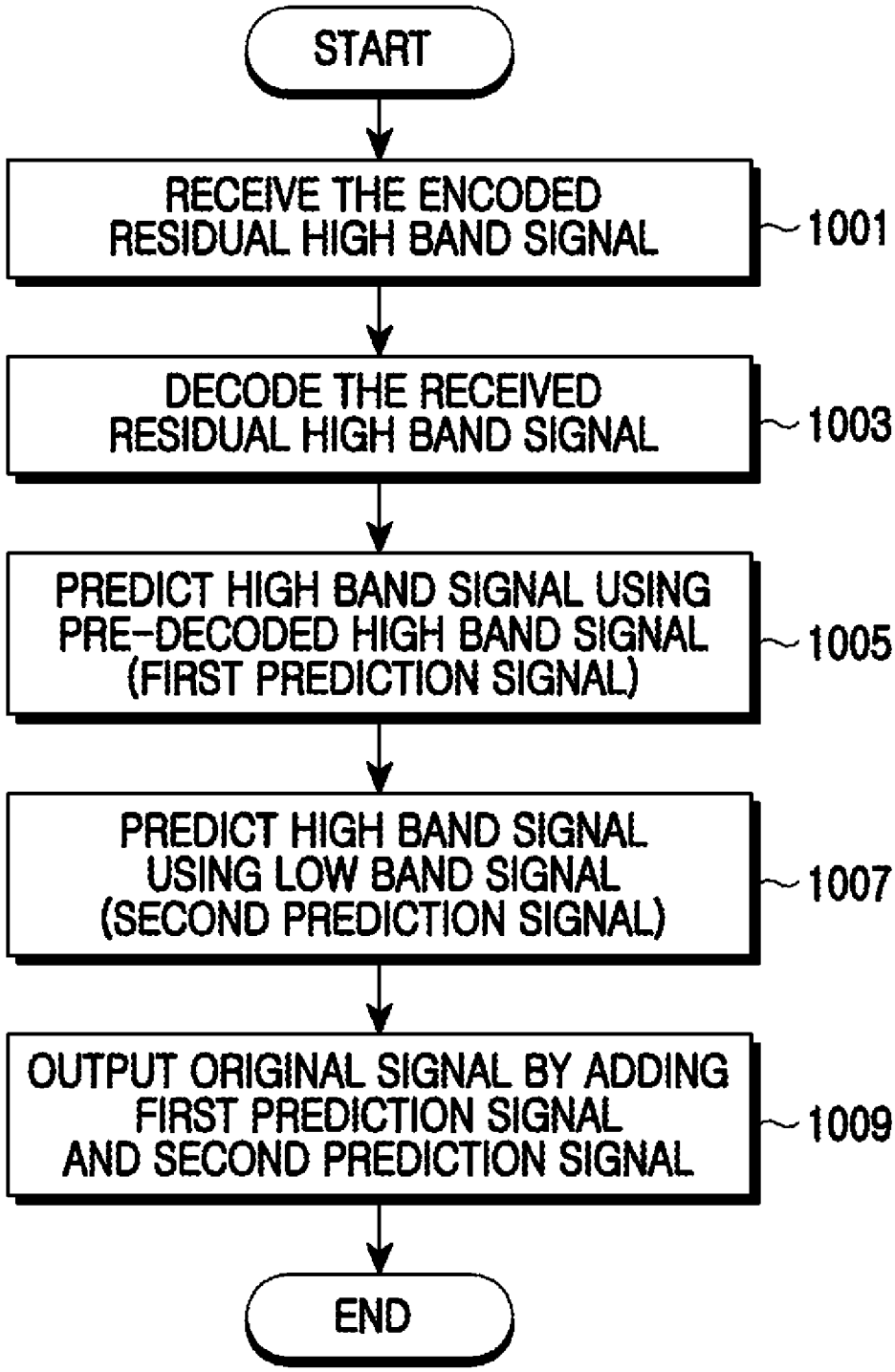
FIG. 10 is a flowchart for increasing coding efficiency by predicting a high band signal at a decoder according to an exemplary embodiment of the present invention.

FIG. 10 is a flowchart for increasing coding efficiency by predicting a high band signal at a decoder according to an exemplary embodiment of the present invention.

The decoder receives the encoded residual high band signal from the encoder in step 1001 and decodes the received residual high band signal in step 1003.

The decoder predicts the high band signal (referred to as a first prediction signal) using the pre-decoded high band signal in step 1005 and predicts the high band signal (referred to as a second prediction signal) using the low band signal in step 1007.

Next, the decoder reproduces the original signal by adding the first prediction signal and the second prediction signal in step 1009 and then finishes this process.

So far, the apparatus and the method for predicting the high band signal using the predictor to raise the coding efficiency at the coding apparatus according to an exemplary embodiment of the present invention have been explained. The coding efficiency can be enhanced by connecting the predictor in serial or in parallel.

FIG. 11 includes graphs illustrating performance of a coding apparatus according to an exemplary embodiment of the present invention.

Figure 11A:
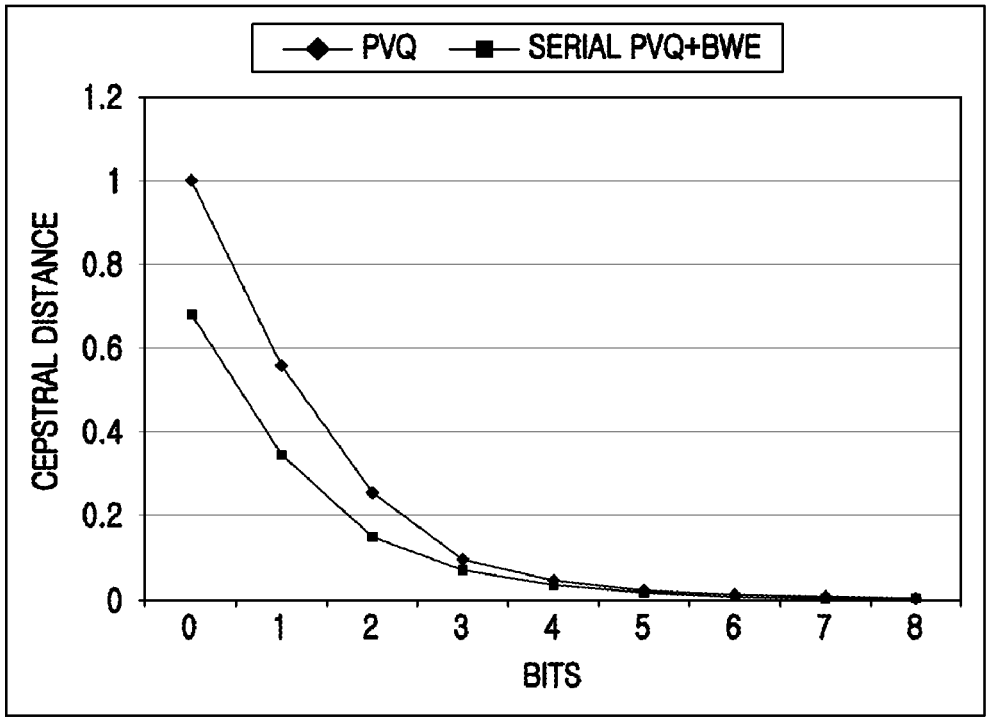
FIG. 11A is a graph illustrating performance of a coding apparatus using serial Predictive Vector Quantization and BandWidth Extension (serial PVQ+BWE) according to an exemplary embodiment of the present invention.

FIG. 11A is a graph illustrating performance of a coding apparatus using serial Predictive Vector Quantization and Bandwidth Extension (serial PVQ+BWE) according to an exemplary embodiment of the present invention.

Figure 11B:
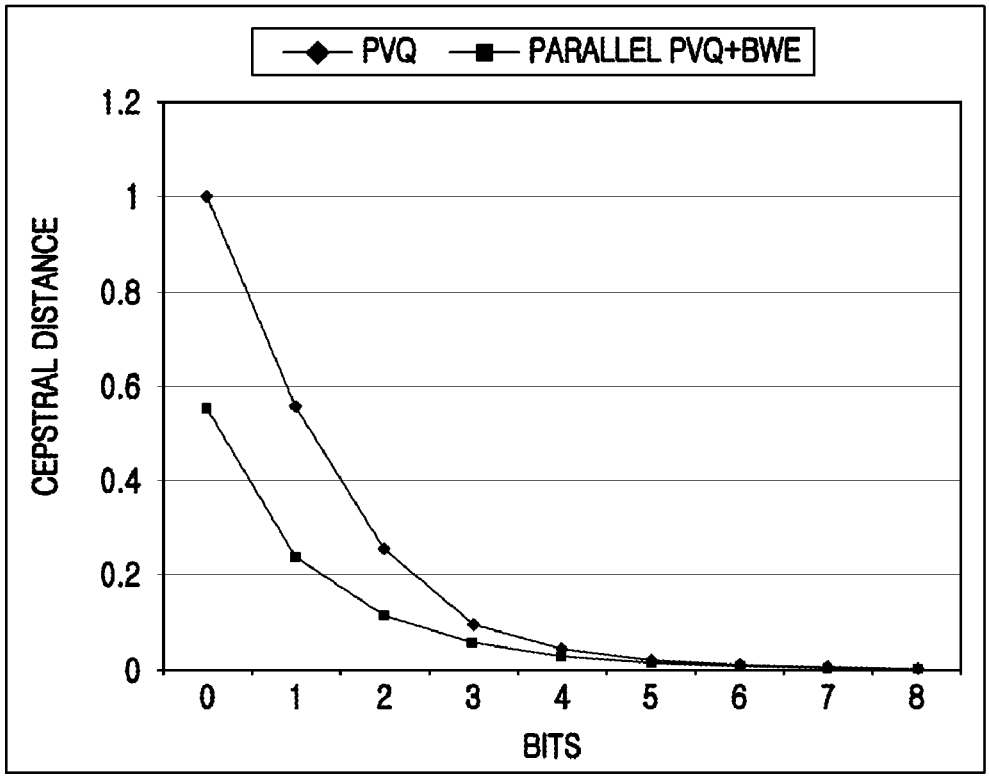
FIG. 11B is a graph illustrating performance of a coding apparatus using parallel Predictive Vector Quantization and BandWidth Extension (parallel PVQ+BWE) according to an exemplary embodiment of the present invention.

FIG. 11B is a graph illustrating performance of a coding apparatus using parallel Predictive Vector Quantization and Bandwidth Extension (parallel PVQ+BWE) according to an exemplary embodiment of the present invention.

In the coding apparatus according to an exemplary embodiment of the present invention, it is assumed that the low band signal is converted with the $15^{th}$ order MFCC feature vector, that is, X={X1, . . . , X18} and the high band signal is converted with the $4^{th}$ order MFCC={Y1, . . . , Y4}, instead of the PCM signal.

In coding the two-dimensional high band vector {Y1, Y2}, Table 5 compares the coding performance of the coding apparatus (the serial PVQ+BWE) with the serially connected predictor which predicts the high band signal and the general coding apparatus (the PVQ). FIG. 11A shows the results of Table 5.

TABLE 5

| Quantization bits | PVQ (CD value) | Serial BWE + PVQ (CD value) |
|---|---|---|
| 0 | 0.999994657 | 0.676158151 |
| 1 | 0.558172709 | 0.345071924 |
| 2 | 0.256129702 | 0.150522626 |
| 3 | 0.096594486 | 0.069829431 |
| 4 | 0.04251647 | 0.033419306 |
| 5 | 0.021238896 | 0.016838908 |
| 6 | 0.010677779 | 0.008480092 |
| 7 | 0.0053574 | 0.004279931 |
| 8 | 0.002699052 | 0.002155239 |

CD denotes the Cepstral Distance value.

In FIG. 11A, the coding apparatus exhibits coding efficiency of about 0.5 bits per 20 ms frame at the low bit rate and about 25 bits per second.

In coding the two-dimensional high band vector {Y1, Y2}, Table 6 compares the coding performance between the coding apparatus (the parallel PVQ+BWE) with the predictor connected in parallel which predicts the high band signal and the general coding apparatus (the PVQ). FIG. 11B shows the results of Table 6.

TABLE 6

| Quantization bits | PVQ (CD value) | Parallel BWE + PVQ (CD value) |
|---|---|---|
| 0 | 0.999994657 | 0.553803491 |
| 1 | 0.558172709 | 0.239484191 |
| 2 | 0.256129702 | 0.116304886 |
| 3 | 0.096594486 | 0.058068495 |
| 4 | 0.04251647 | 0.029213927 |
| 5 | 0.021238896 | 0.014755009 |
| 6 | 0.010677779 | 0.00754634 |
| 7 | 0.0053574 | 0.003828885 |
| 8 | 0.002699052 | 0.001913953 |

CD denotes the Cepstral Distance value.

In FIG. 11B, the coding apparatus exhibits coding efficiency of about 1 bit per 20 ms frame at the low bit rate and about 50 bits per second.

As such, the coding apparatus can predict and encode the high band signal using the scalar scheme or the vector scheme according to the purpose of the application.

Figure 12:
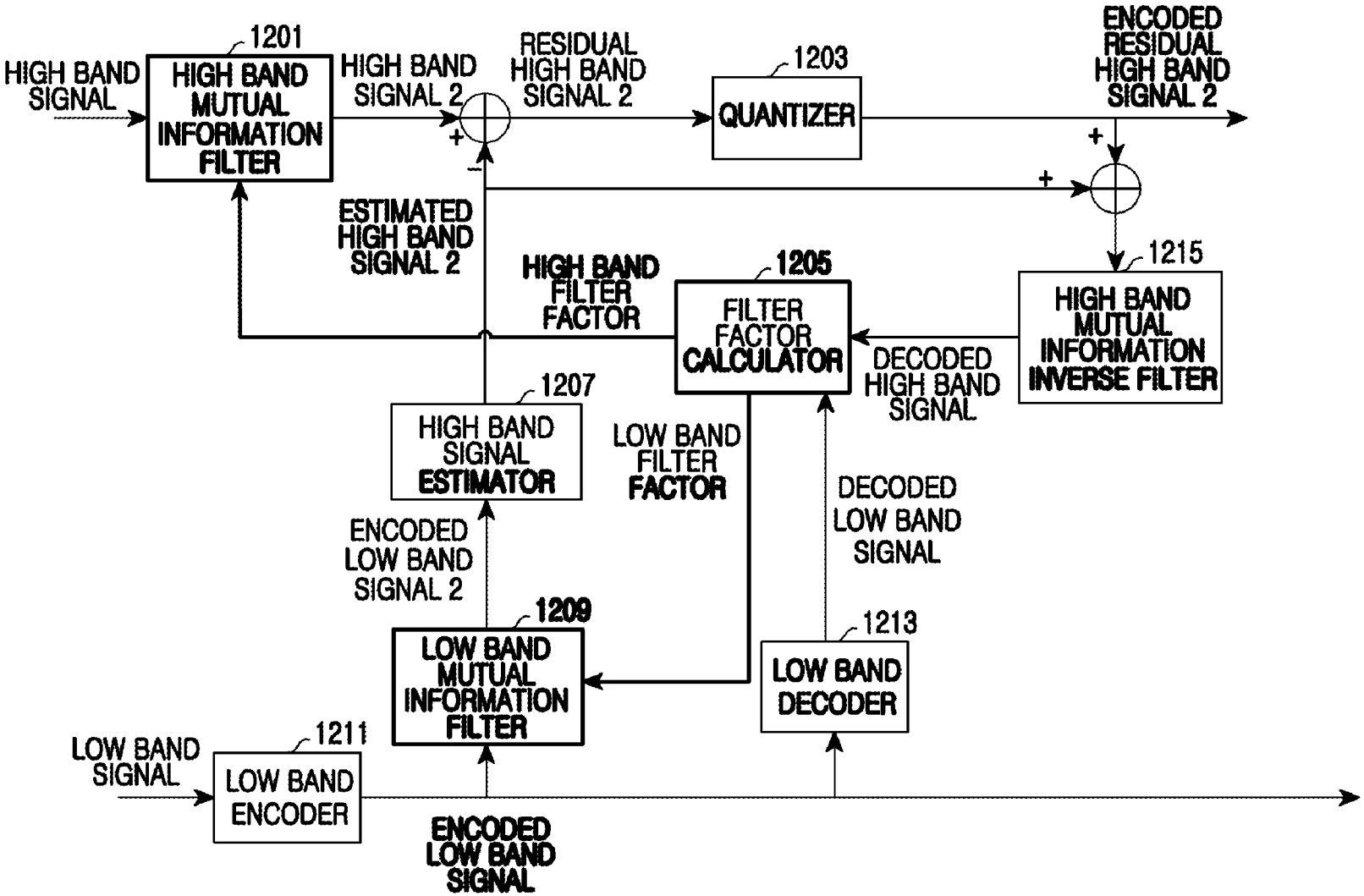
FIG. 12 is a block diagram of an encoder of a portable terminal according to an exemplary embodiment of the present invention.

FIG. 12 is a block diagram of an encoder of a portable terminal according to an exemplary embodiment of the present invention.

The encoder of FIG. 12 may include a high band mutual information filter 1201, a quantizer 1203, a filter factor calculator 1205, a high band signal estimator 1207, a low band mutual information filter 1209, a low band encoder 1211, a low band decoder 1213, and a high band mutual information inverse filter 1215.

The low band encoder 1211 processes to encode and transmit the low band signal over the communication channel, and enables the high band signal estimator 1207 to estimate the high band signal using the encoded low band signal.

The low band mutual information filter 1209 increases the mutual information of the encoded low band signal using the filter factor provided from the filter factor calculator 1205.

The high band mutual information filter 1201 converts the input high band signal using the filter factor provided from the filter factor calculator 1205. That is, the high band mutual information filter 1201 converts the pre-received high band signal (a first high band signal) to the output high band signal (a second high band signal) with the increased mutual information.

The filter factor calculator 1205 determines the low band filter factor and the high band filter factor required to increase the mutual information of the two input signals using the decoded high band signal provided from the high band mutual information inverse filter 1215 and the low band signal decoded by the low band decoder 1213, and provides the factors to the respective filters.

Herein, the decoded high band signal provided from the high band mutual information inverse filter 1215 includes the fed back signal which is decoded from the encoded high band signal of the previous frame, and the decoded low band signal is the signal decoded from the encoded low band signal of the current frame.

The encoder processes to output the residual high band signal (the second residual high band signal) by subtracting the high band signal (the second high band signal) converted by the high band mutual information filter 1201 and the high band signal estimated by the high band signal estimator 1207, and controls the quantizer 1203 to quantize the signal.

Figure 13:
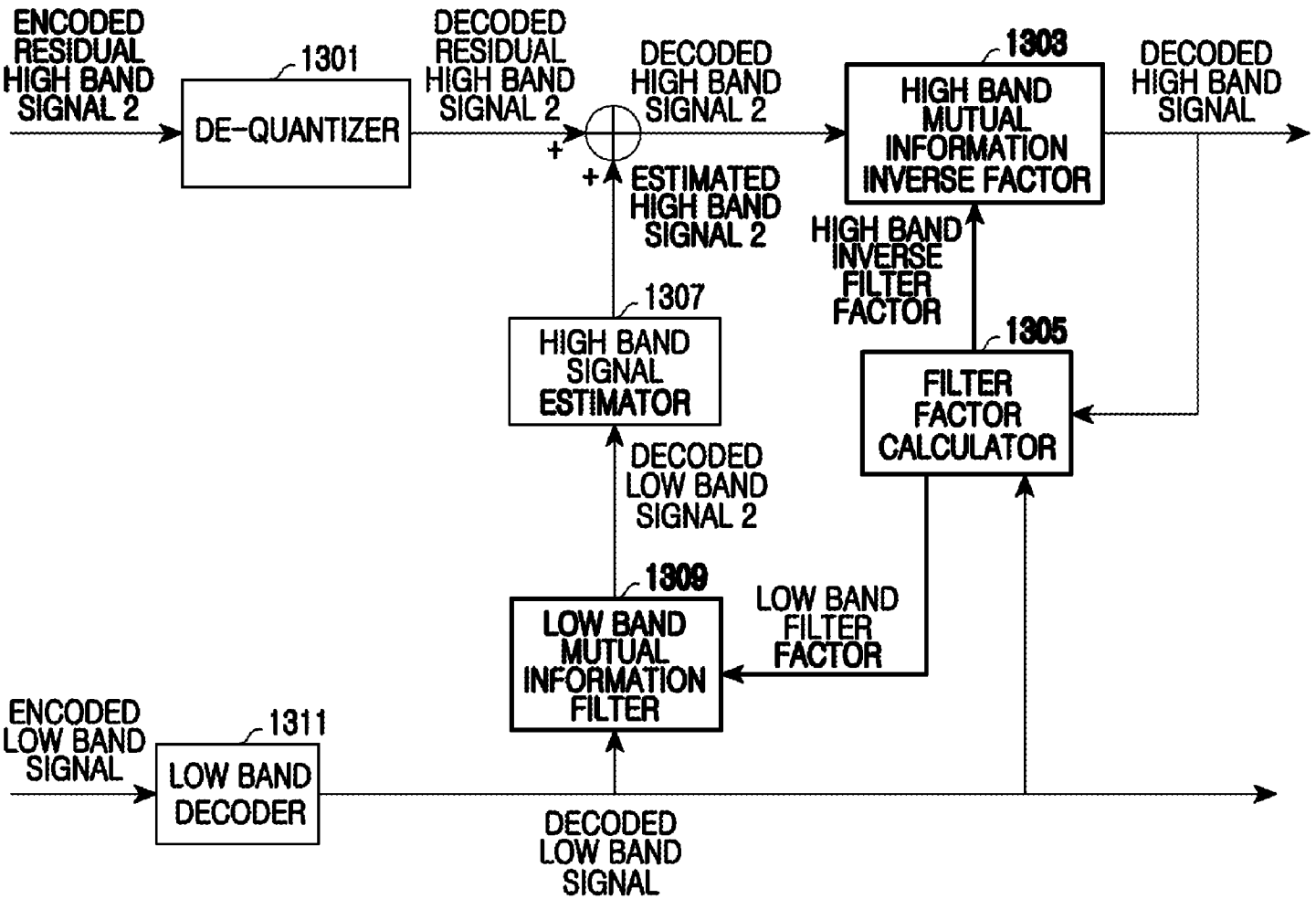
FIG. 13 is a block diagram of a decoder of a portable terminal according to an exemplary embodiment of the present invention.

FIG. 13 is a block diagram of a decoder of a portable terminal according to an exemplary embodiment of the present invention.

The decoder of FIG. 13 includes a dequantizer 1301, a high band mutual information inverse filter 1303, a filter factor calculator 1305, a high band signal estimator 1307, a low band mutual information filter 1309, and a low band decoder 1311.

The low band decoder 1311 decodes the encoded low band signal and enables the high band signal estimator 1307 to estimate the high band signal using the decoded low band signal.

The dequantizer 1301 receives and de-quantizes the encoded residual high band signal (the second encoded residual high band signal) and outputs the decoded residual high band signal (the second decoded residual high band signal).

The filter factor calculator 1305 determines a low band filter factor and a high band inverse filter factor using the decoded high band signal and the decoded low band signal, and provides the factors to the respective filters. Herein, the low band filter factor determined at the filter factor calculator 1305 is the same as the low band filter factor of the transmitter with respect to the same frame, and the high band filter inverse filter factor is the same as the high band inverse filter factor of the transmitter and has an inverse relation with the high band filter factor of the transmitter.

The low band mutual information filter 1309 increases the mutual information of the decoded low band signal using the factor provided from the filter factor calculator 1305 and provides the decoded low band signal to the high band signal estimator 1307 to estimate the high band signal.

Hence, the decoder adds the residual high band signal decoded by the dequantizer 1301 and the high band signal estimated by the high band signal estimator 1307 and outputs the decoded high band signal (the second decoded high band signal) to the high band mutual information inverse filter 1303.

The high band mutual information inverse filter 1303 inversely filters the decoded high band signal (the second decoded high band signal) using the inverse filter factor provided from the filter factor calculator 1305 and processes to reproduce the original high band signal.

Figure 14:
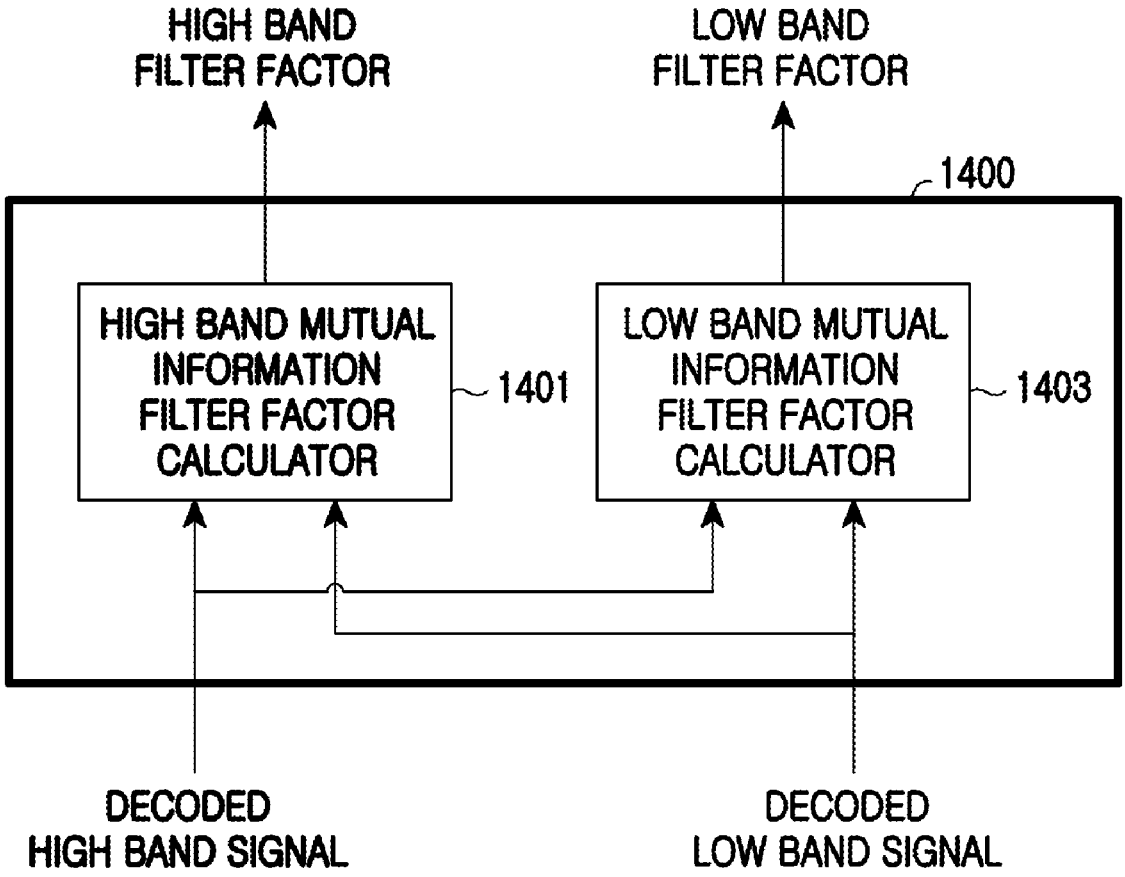
FIG. 14 is a block diagram of a filter factor calculator of an encoder according to an exemplary embodiment of the present invention.

FIG. 14 is a block diagram of a filter factor calculator applied to an encoder according to an exemplary embodiment of the present invention.

The filter factor calculator 1400 applied to the encoder in FIG. 14 includes a high band mutual information filter factor calculator 1401 and a low band mutual information filter factor calculator 1403.

The high band mutual information filter factor calculator 1401 determines the factor of the high band mutual information filter. The high band mutual information filter factor calculator 1401 can determine the factor using the decoded high band signal and the decoded low band signal.

The low band mutual information filter factor calculator 1403 determines the factor of the low band mutual information filter. The low band mutual information filter factor calculator 1403 can determine the factor using the decoded high band signal and the decoded low band signal.

To determine the filter factor for increasing the mutual information of the high band signal, the filter factor calculator 1400 of the encoder should meet the following conditions.

It is assumed that the low band signal is X, the high band signal is Y, the high band mutual information filter is H[ ], the high band mutual information inverse filter is $H^{-1}$[ ], and the high band signal converted by H[ ] is Y2.

First, H[ ] should be reversible, and $H^{-1}$[ ] should exist to establish $Y=H^{-1}[Y2]=H^{-1}[H[Y]]$. That is, it should be possible to reproduce the original signal Y from the converted signal Y2.

Second, the mutual information I[X;Y2]>I[X;Y] should be established.

Third, the dynamic range of Y2 should not be greater than at least that of Y in the statistical sense.

Figure 16:
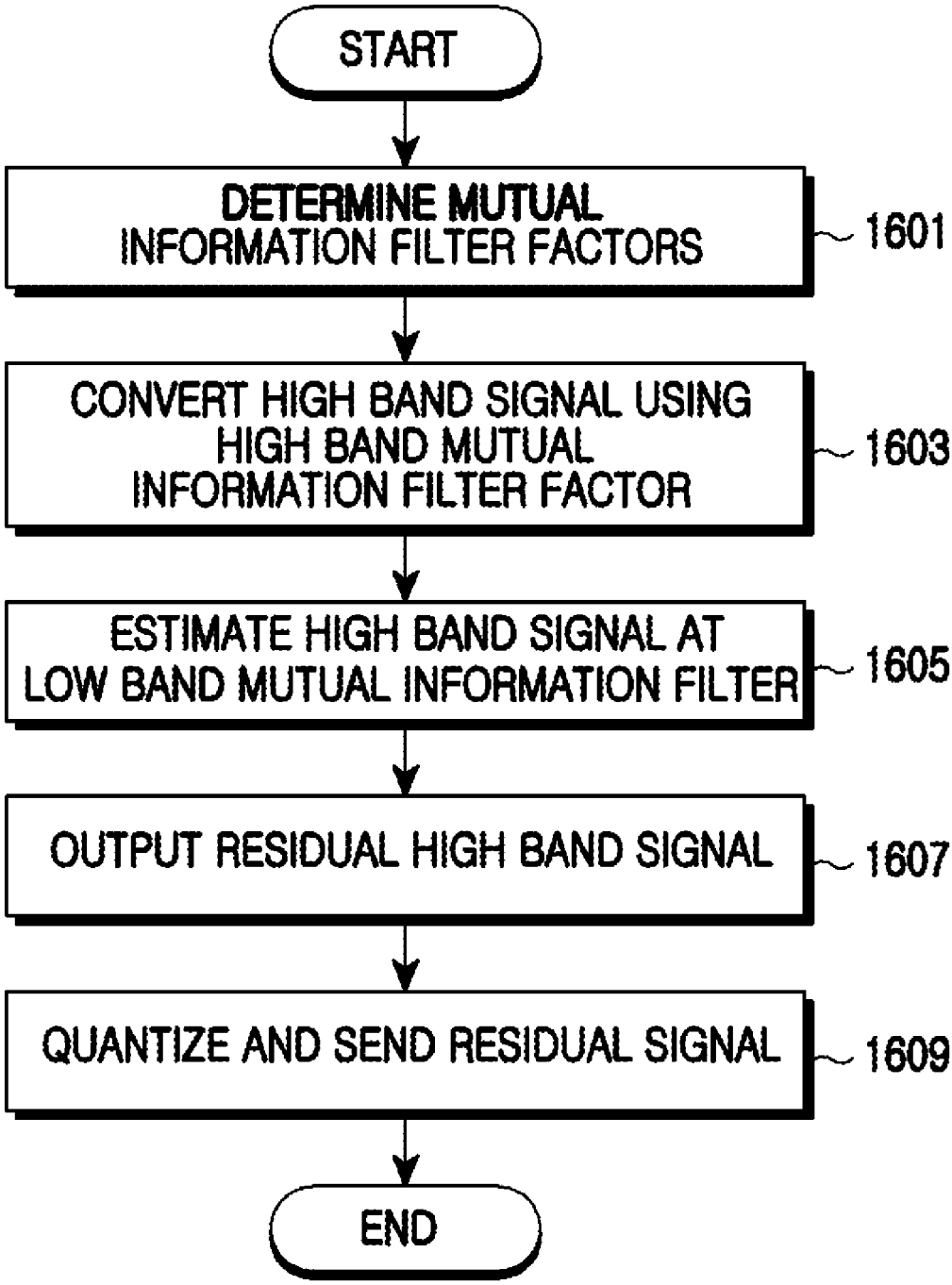
FIG. 16 is a flowchart illustrating operations of an encoder according to an exemplary embodiment of the present invention.

The conditions to be satisfied in the filter factor calculation shall be described in more detail by referring to FIG. 16.

Figure 15:
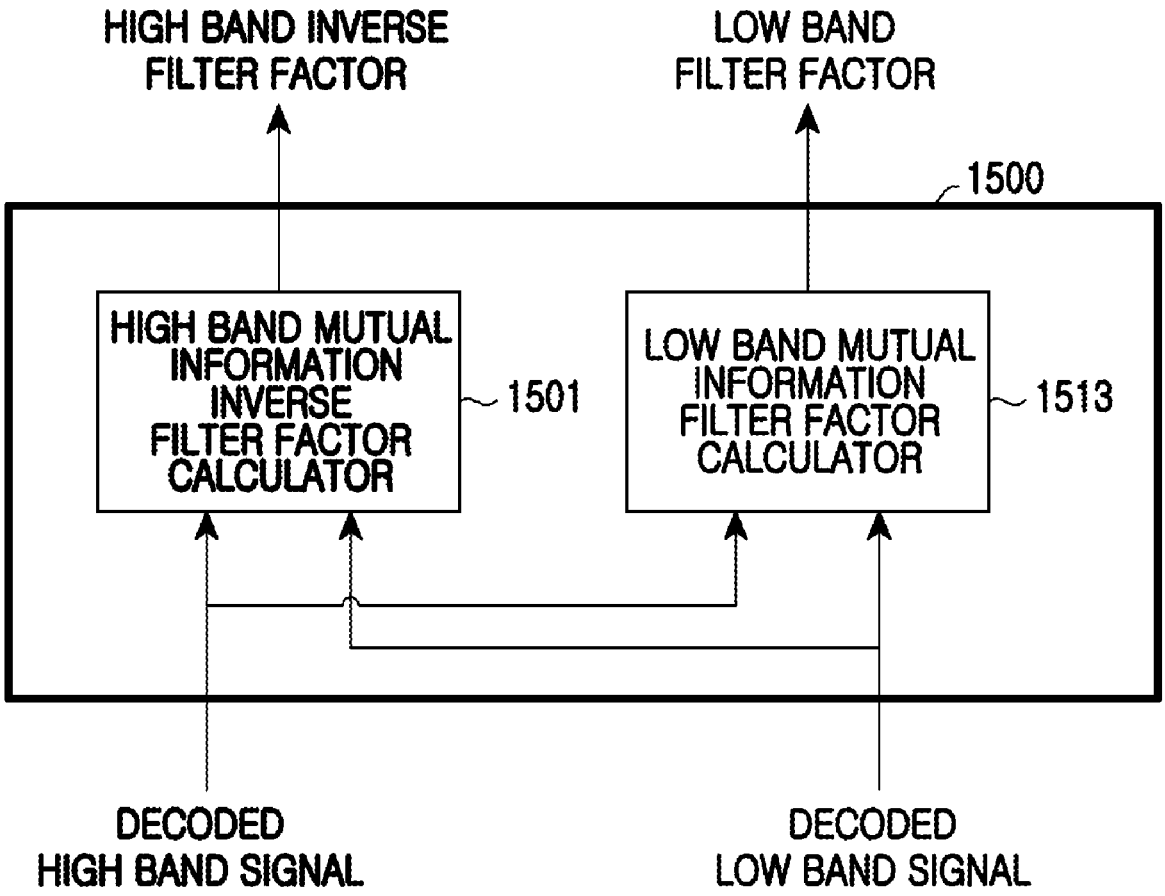
FIG. 15 is a block diagram of a filter factor calculator of a decoder according to an exemplary embodiment of the present invention.

FIG. 15 is a block diagram of a filter factor calculator of a decoder according to an exemplary embodiment of the present invention.

The filter factor calculator 1500 applied to the decoder in FIG. 15 includes a high band mutual information inverse filter factor calculator 1501 and a low band mutual information filter factor calculator 1513.

The high band mutual information inverse filter factor calculator 1501 determines the factor of the high band mutual information inverse filter. The high band mutual information inverse filter factor calculator 1501 can determine the factor using the decoded high band signal and the decoded low band signal.

The low band mutual information filter factor calculator 1513 determines the factor of the low band mutual information filter. The low band mutual information filter factor calculator 1513 can determine the factor using the decoded high band signal and the decoded low band signal.

Herein, the filter factor calculator 1500 of the decoder should determine the filter factors to increase the mutual information of the high band signal while satisfying the conditions as in the filter factor calculator 1400 of the encoder as described earlier with respect to FIG. 14.

So far, the apparatuses for controlling the correlation (the mutual information) affecting the coding efficiency in the coding apparatus of the portable terminal using the BWE have been described. Now, explanations are provided regarding methods for controlling the correlation (the mutual information) affecting the coding efficiency using the apparatuses according to exemplary embodiments of the present invention.

FIG. 16 is a flowchart illustrating operations of an encoder according to an exemplary embodiment of the present invention. Herein, the encoder performs the artificial BWE on the high band of the input signal to increase the mutual information between the high band and the low band. Accordingly, the encoder encodes the low band signal using the low band encoder and outputs the encoded low band signal.

The encoder determines the mutual information filter factors in step 1601 and converts the input high band signal (the first high band signal) using the determined filter factors in step 1603. Herein, the mutual information filter factors include the factor of the high band mutual information filter and the factor of the low band mutual information filter, which are determined at the filter factor calculator. The converted high band signal (the second high band signal) indicates the output high band signal with the increased mutual information, relative to the input high band signal.

The filter factor calculator should meet the following conditions.

It is assumed that the low band signal is X, the high band signal is Y, the high band mutual information filter is H[ ], the high band mutual information inverse filter is $H^{-1}$[ ], and the high band signal converted by H[ ] is Y2.

First, H[ ] should be reversible, and $H^{-1}$[ ] should exist to establish $Y=H^{-1}[Y2]=H^{-1}[H[Y]]$. That is, it should be possible to reproduce the original signal Y from the converted signal Y2.

Second, the mutual information I[X;Y2]>I[X;Y] should be established.

Third, the dynamic range of Y2 should not be greater than at least that of Y in the statistical sense.

The first condition implies that the signal converted by the high band mutual information filter of the transmitter should be recovered by the high band mutual information inverse filter of the receiver, and the second and third conditions imply that the conversion by the filter H[ ] should contribute to the enhancement of the coding efficiency.

As for the first condition, that is, as for $H^{-1}$[ ], the filter H[ ] fundamentally represents a monotonic and differentiable function, whereas the mutual information does not change for the conversion function. That is, I[X;Y2]=I[X;Y], which cannot meet the second condition.

To address this problem, exemplary embodiments of the present invention introduce the expression "reversible" to define the function which ultimately enables reproduction of the original transmit information Y using the other transmit information, e.g., using the low band vector X.

For example, $Y2=H[X,Y]=X\cdot*=\{x_1y_1, \ldots, x_Ny_N\}'$. $\cdot*$ denotes the multiplication between the components. $x_1$ and $y_1$ denote the components of X and Y. The inverse function $H^{-1}$[ ], that is, the function of reproducing Y from Y2 with the given X can be defined as $Y=H^{-1}[X,Y2]=X\cdot/2,=\{x_1/y2_1, \ldots, x_N/y2_N\}$. $\cdot/$ denotes the division between the components and $x_1$ and $y2_1$ denote the components of X and Y2.

Y2, sent from the transmitter using the function $\cdot*$, can be recovered to Y at the receiver using the function $\cdot/$. As for the second condition, when the two random variables (or vectors) have mutual dependence, that is, the mutual function relation, their mutual information generally increases. In other words, when Y2 converted by the filter H[ ] has a certain function relation with X, e.g., the function relation of $Y2=f[X]$, the mutual information of the two random vectors Y2 and X increases.

Next, the encoder controls the low band mutual information filter to estimate the high band signal in step 1605 and processes to output the residual high band signal (the second residual high band signal) in step 1607.

Herein, the residual high band output signal is produced by subtracting the high band signal (the second high band signal) converted in step 1603 and the high band signal estimated in step 1605.

In step 1609, the encoder quantizes the residual signal and transmits the quantized residual signal (the second encoded residual high band signal) over the communication channel. Herein, the quantizer for quantizing the residual signal can employ a scalar or vector quantizer according to the purpose of the application.

Next, the encoder finishes this process.

Figure 17:
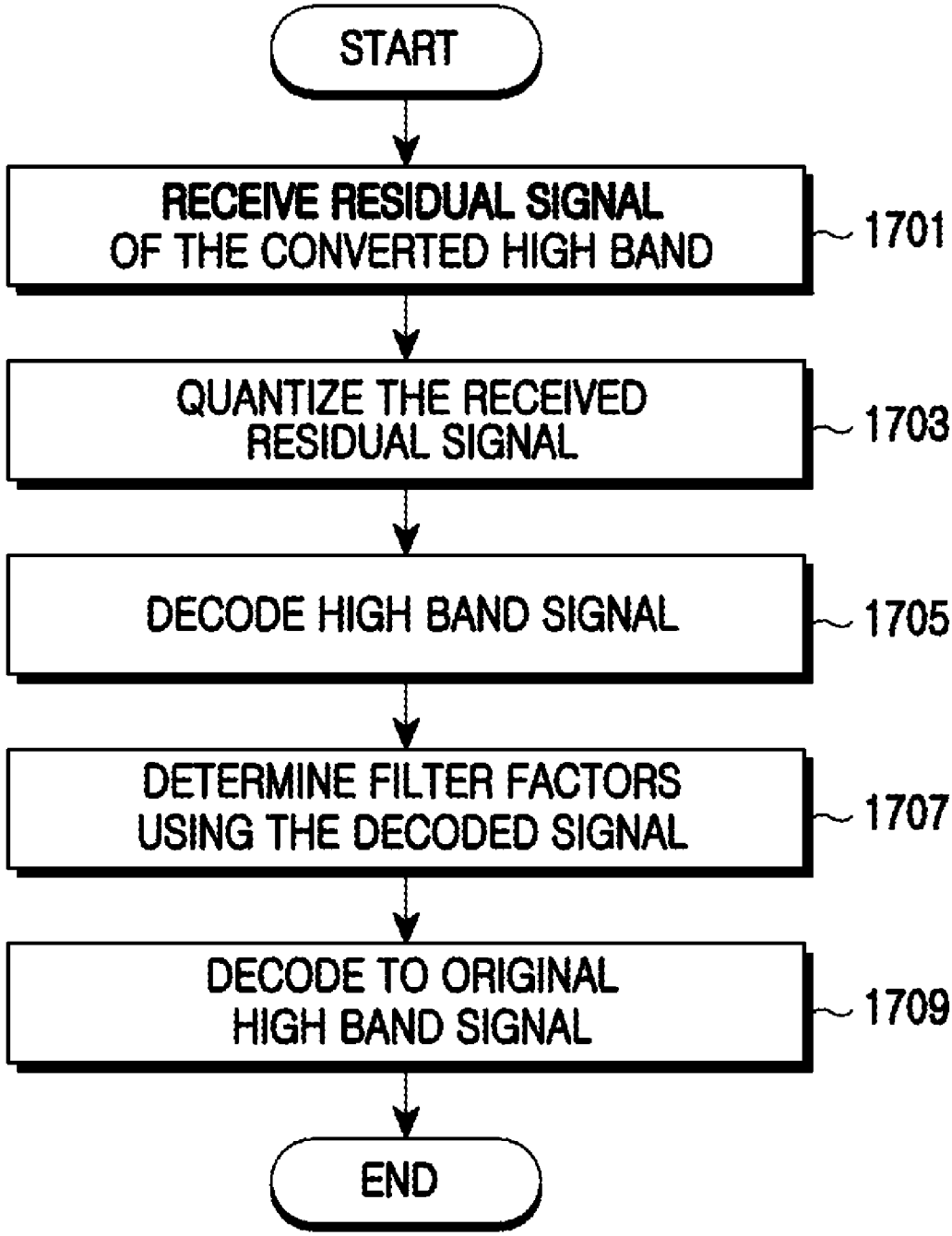
FIG. 17 is a flowchart illustrating operations of a decoder according to an exemplary embodiment of the present invention.

FIG. 17 is a flowchart illustrating operations of a decoder according to an exemplary embodiment of the present invention. Herein, the decoder processes to decode the input signal with the increased mutual information between the high band and the low band. The decoder controls the low band decoder to decode the encoded low band signal received in the communication channel and reproduces the low band signal.

In step 1701, the decoder receives the residual signal (the second encoded residual high band signal) of the high band converted by the encoder.

The decoder quantizes the received residual signal in step 1703 and decodes to the high band signal in step 1705. In more detail, the decoder outputs the second encoded residual high band signal received, as the second decoded residual high band signal.

In step 1707, the decoder determines the filter factors using the decoded signal. Herein, the filter factors include the low band filter factor and the high band inverse filter factor. The decoder can determine the filter factors using the decoded high band signal and the decoded low band signal. The low band filter factor is the same as the low band filter factor of the transmitter in the same frame, and the high band inverse filter factor is the same as the high band inverse filter factor of the transmitter and has the inverse relation with the high band filter factor of the transmitter.

In step 1709, the decoder decodes to the original high band signal.

The decoding to the original high band signal reproduces the decoded high band signal (the second decoded high band signal) by adding the second residual high band signal decoded in step 1705 and the high band signal estimated by the high band signal estimator, inversely filters the decoded high band signal, and decodes to the original high band signal.

Next, the decoder finishes this process.

Figure 18:
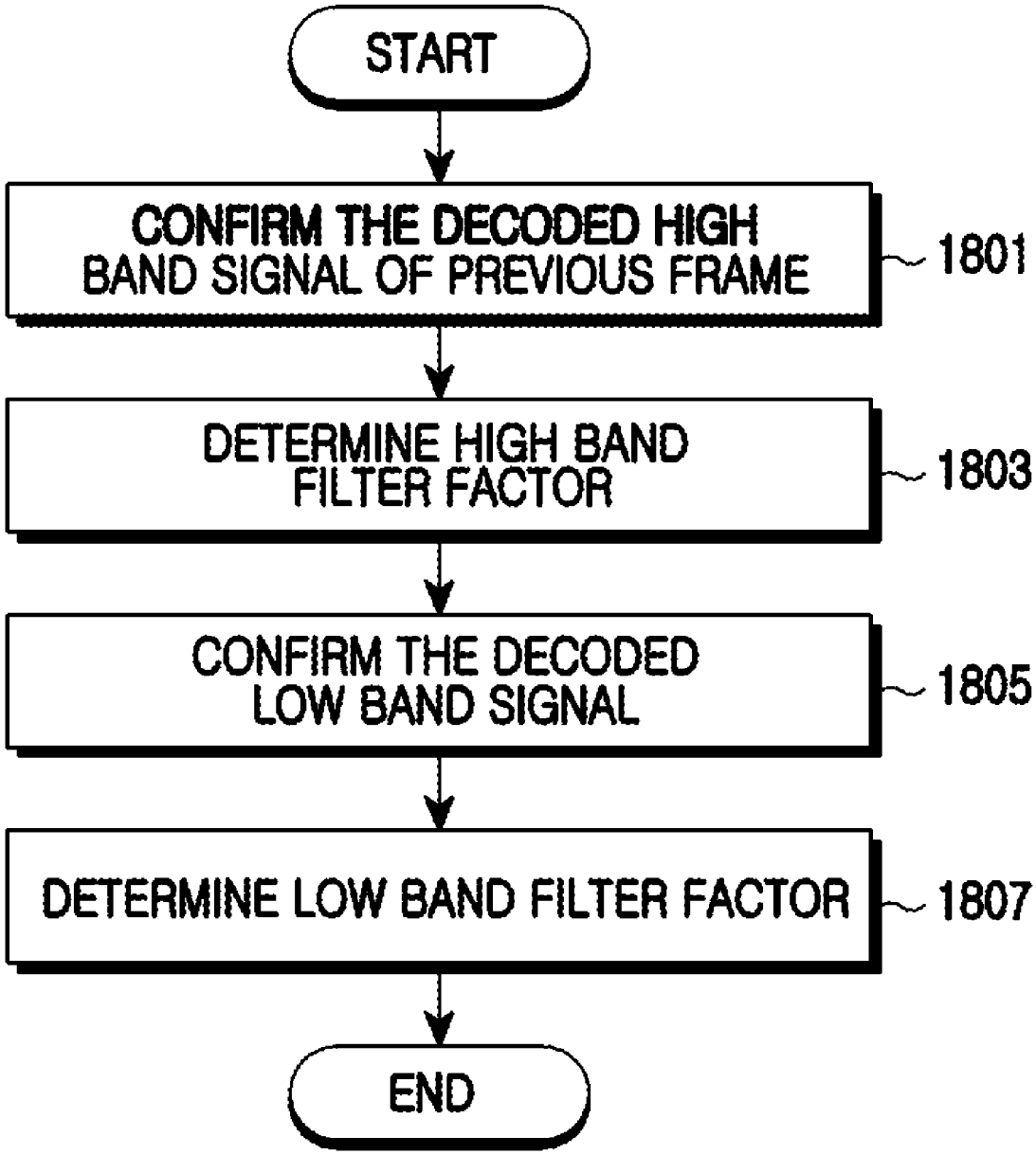
FIG. 18 is a flowchart of a method for determining filter factors at a filter factor calculator according to an exemplary embodiment of the present invention.

FIG. 18 is a flowchart of a method for determining filter factors at a filter factor calculator according to an exemplary embodiment of the present invention.

The filter factor calculator confirms the decoded high band signal of the previous frame in step 1801 and determines the high band filter factor in step 1803. More specifically, the filter factor calculator determines the filter for increasing the mutual information of the input high band signal by use of the decoded high band signal of the previous frame.

The filter factor calculator confirms the decoded low band signal in step 1805 and determines the low band filter factor in step 1807. Herein, the filter factor calculator determines the filter for increasing the mutual information of the input signal using the decoded low band signal which is the decoded signal of the encoded low band signal of the current frame.

Next, the filter factor calculator finishes this process.

While an exemplary apparatus and method for increasing the mutual information of the high band signal and the low band signal utilize the filter factor of the high band signal and the filter factor of the low band signal, the mutual information of the high band signal and the low band signal can be raised by applying only one of the high band mutual information filter and the low band mutual information filter.

The method for adopting only the high band mutual information filter or only the low band mutual information filter is substantially the same as the method using both of the high band mutual information filter and the low band mutual information filter in FIGS. 2 through 8, but can increase the mutual information of the high band signal and the low band signal merely using either filter.

FIG. 19 includes graphs illustrating performance of a decoder according to an exemplary embodiment of the present invention.

As stated earlier, an exemplary method for increasing the mutual information of the high band vector and the low band vector can employ both or only one of the high band mutual information filter and the low band mutual information filter.

In FIG. 19, an exemplary method employing only the high band mutual information filter and an exemplary method employing only the low band mutual information filter are illustrated.

Figure 19A:
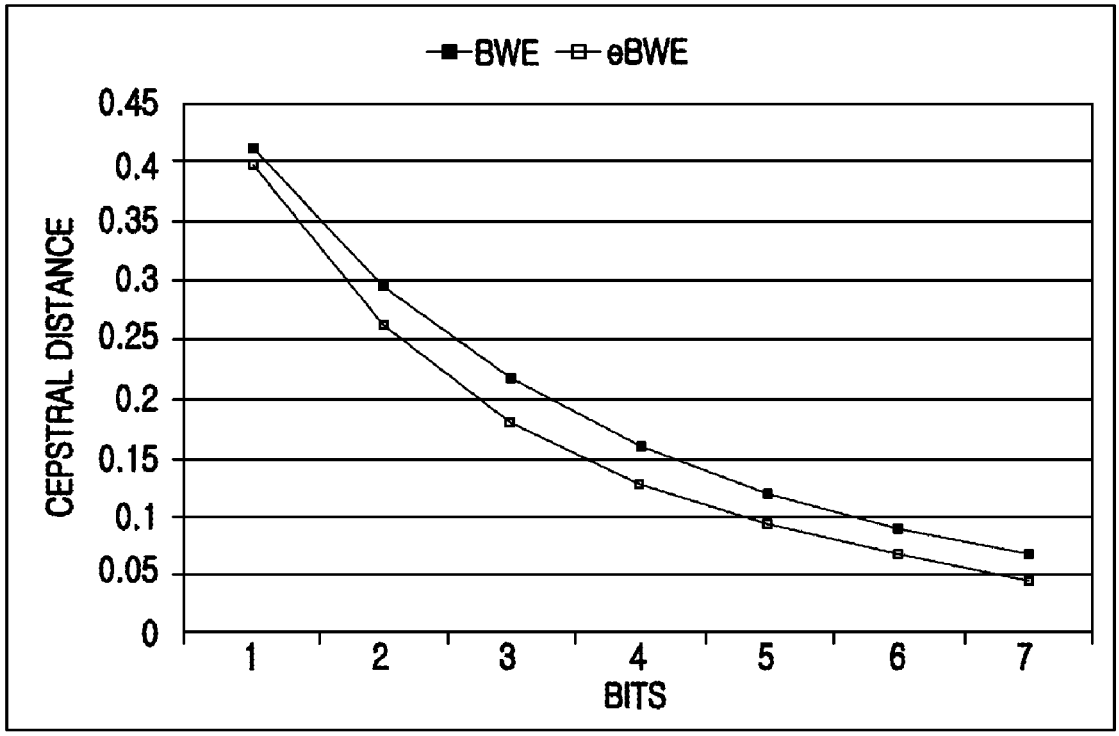
FIG. 19A is a graph comparing performance of a coding apparatus employing only a high band mutual information filter according to an exemplary embodiment of the present invention and a conventional coding apparatus.
Figure 19B:
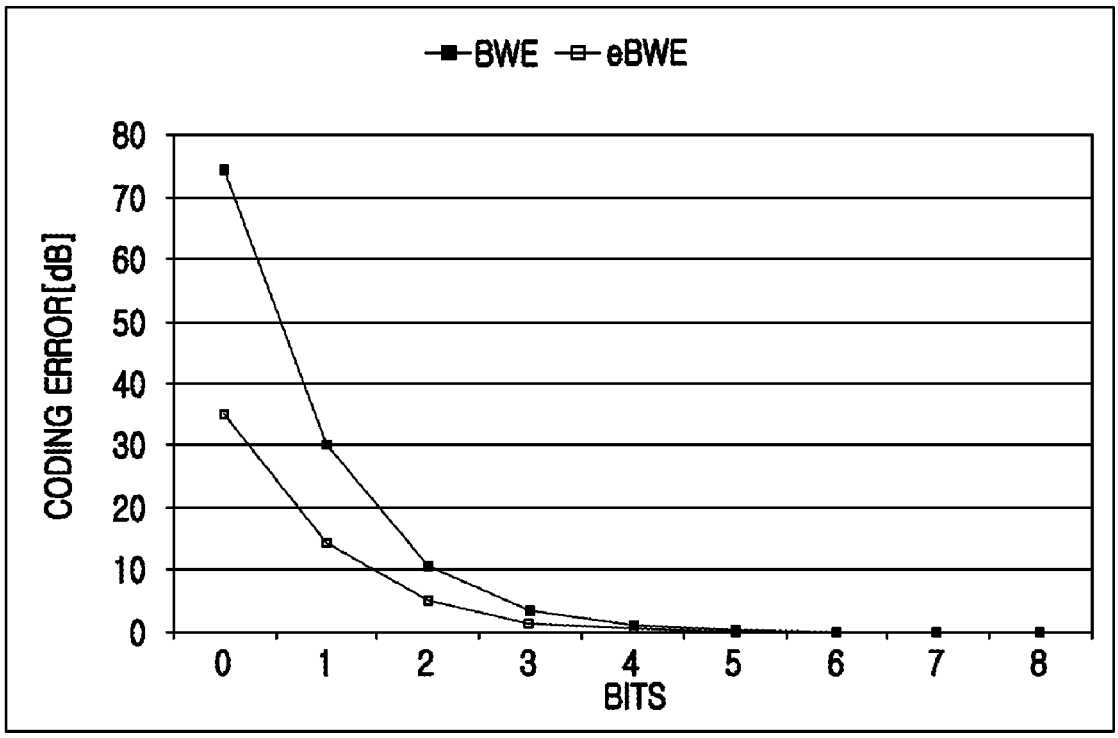
FIG. 19B is a graph comparing performance of a coding apparatus employing only a low band mutual information filter according to an exemplary embodiment of the present invention and a conventional coding apparatus Throughout the drawings, like reference numerals will be understood to refer to like parts, components and structures.

FIG. 19A is a graph comparing performance of an exemplary coding apparatus employing only a high band mutual information filter and a conventional coding apparatus. FIG. 19B is a graph comparing performance of an exemplary coding apparatus employing only the low band mutual information filter and a conventional coding apparatus.

To compare performance of the coding apparatus of a conventional portable terminal and a coding apparatus according to an exemplary embodiment of the present invention, the low band signal of the PCM voice signal sampled at 16 kHz is converted to the $14^{th}$ order MFCC feature vector and log scaled energy, that is, to $X(n)=\{x1(n), \ldots, x14(n), \ln E_{LB}(n)\}$, and the corresponding high band signal is converted to the $4^{th}$ order MFCC factor and the log scaled energy, that is, to $Y(n)=\{y1(n), \ldots, y4(n), \ln E_{HB}(n)\}'$. n denotes a frame number and the frame size is 20 ms. In this situation, the coding issue is to code the $4^{th}$ order high band MFCC and the energy information Y(n) with efficiency.

Prior to the operations of the coding apparatus employing only the high band mutual information filter, provided that the coding apparatus codes only $E_{HB}$ of the high band signal in Y(n) information, the high band signal is $Y(n)=\{\ln E_{HB}(n)\}$. An exemplary high band mutual information filter for converting the original high band signal Y(n) to Y2(n) can be expressed as Equation (2).

$$Y2(n)=H[X(n),Y(n-1)]=\ln E_{HB}(n)-\ln E_{LB}(n)=\ln(E_{HB}(n)/E_{LB}(n)) \quad (2)$$

In Equation (2), X denotes the low band signal, Y denotes the high band signal, H[ ] denotes the high band mutual information filter, Y2 denotes the high band signal converted by H[ ], $E_{HB}$ denotes the energy of the high band signal, and $E_{LB}$ denotes the energy of the low band signal. Y(n−1) denotes the encoded high band vector of the (n−1)-th frame fed back.

In Equation (2), the high band mutual information filter corresponds to the differential operation in the log scale and to the division in the linear scale.

The high band mutual information filter meets the first condition (that H[ ] should be reversible and $H^{-1}$[ ] should exist to establish $Y=H^{-1}[Y2]=H^{-1}[H[Y]]$, that is, it should be possible to reproduce the original signal Y from the converted signal Y2) of the three conditions aforementioned. Namely, the original high band signal can be restored from the high band signal Y2 converted by the high band mutual information filter and the component $\ln E_{LB}$ (n) of the low band signal (X(n)), which is expressed as Equation (3).

$$\ln E_{HB}(n)=Y2(n)+\ln E_{LB}(n) \quad (3)$$

In Equation (3), $E_{HB}$ denotes the energy of the high band signal, $E_{LB}$ denotes the energy of the low band signal, and Y2 denotes the high band signal converted by the high band mutual information filter.

Equation (2) meets the second condition (that the mutual information I[X;Y2]>I[X;Y] should be established) of the three conditions based on Equation (4).

$$I[X(n);Y2(n)]=1.27>I[X(n);Y(n)]=0.71 \quad (4)$$

In Equation (4), X denotes the low band signal, Y denotes the high band signal, and Y2 denotes the high band signal converted by the high band mutual information filter.

In Equation (4), the mutual information of Y2 increases by about 0.56 bit, compared to the mutual information of Y, which implies the enhancement of the coding efficiency of 0.56 bit per frame and 28 bits per second in the coding of the high band energy $Y(n)=\{\ln E_{HB}(n)\}$. The variance of Y is about 74.44 and the variance of Y2 is about 35.06. Thus, Equation (2) meets the third condition (that the dynamic range of Y2 should not be greater than at least that of Y in the statistical sense).

The mutual information between the two vectors in Equation (4) can be expressed as Equation (5).

$$I(X;Y)=\int_{\Omega y}\int_{\Omega x} f_{X,Y}(x,y)\log_2\left(\frac{f_{X,Y}(x,y)}{f_X(y)f_Y(y)}\right) \quad (5)$$

In Equation (5), X denotes the feature vector of the low band signal and Y denotes the feature vector of the high band signal. $f_X(x)$ denotes a probability density function of X, $f_Y(y)$ denotes a probability density function of Y, and $f_{XY}(x, y)$ denotes a joint probability density function of X and Y.

As above, the filter defined in Equation (2) satisfies all of the three conditions as the high band mutual information filter and raises the coding efficiency of the high band energy $Y(n)=\{\ln E_{HB}(n)\}$.

Table 7 compares the performance of a conventional coding apparatus (BWE) and an exemplary embodiment of the present invention (eBWE), and FIG. 19A illustrates performance of an exemplary coding apparatus employing only the high band mutual information filter and a conventional coding apparatus.

TABLE 7

| Quantization bits | BWE | eBWE |
|---|---|---|
| 0 | 74.44139682 | 35.04823669 |
| 1 | 29.9638428 | 14.41622256 |
| 2 | 10.48636178 | 4.902777868 |
| 3 | 3.237544251 | 1.483840889 |
| 4 | 0.879504628 | 0.412519595 |
| 5 | 0.228972655 | 0.108508489 |
| 6 | 0.058430905 | 0.028144785 |
| 7 | 0.014838623 | 0.007102297 |
| 8 | 0.003612276 | 0.001717147 |

The values in Table 7 indicate the coding error energy, which implies that the exemplary coding apparatus improves the coding performance further than the general coding apparatus.

Operations of another exemplary coding apparatus employing only the low band mutual information filter are described now.

Prior to the exemplary method for raising the coding efficiency by employing only the low band mutual information filter, provided that the coding apparatus codes only the $4^{th}$ order MFCC of the high band signal in Y(n) information, the high band signal is $Y(n)=\{y1(n), \ldots, y4(n)\}$. An exemplary low band mutual information filter for converting the original low band signal X(n) to X2(n) can be expressed as Equation (6).

$$X2(n)=G[X(n),Y(n-1)]=\{X(n):Y(n-1)\}'=\{x_1(n), \ldots, x_{14}(n):y_1(n-1), \ldots, y_4(n-1)\}' \quad (6)$$

In Equation (6), X denotes the low band signal, Y denotes the high band signal, G[ ] a denotes the low band mutual information filter, X2 denotes the low band signal converted by G[ ], : denotes an augmentation operator in the matrix and the vector, and Y(n−1) denotes the encoded high band vector of the (n−1)-th frame fed back.

The low band mutual information filter in Equation (6) indicates the augmentation operator which outputs an augmented vector.

The low band mutual information filter satisfies the second of the three necessary conditions of the present mutual information filter. The mutual information increases by the augmented vector X2 based on Equation (7).

According to the mutual information computation based on Equation (7), as the low band signal is changed from X to X2, the mutual information increases by approximately 1 bit. This predicts the enhancement of the coding efficiency of 1 bit per frame and 50 bits per second when the $4^{th}$ order high band MFCC Y is coded. The first and third of the three necessary conditions of the present mutual information filter relate to the high band mutual information filter. When the low band mutual information filter alone is employed, the first and third conditions do not apply.

Table 8 compares performance of a conventional coding apparatus (BWE) and an exemplary coding apparatus (eBWE), and FIG. 19B illustrates performance of an exemplary coding apparatus employing only the low band mutual information filter and a conventional coding apparatus.

TABLE 8

| Quantization bits | BWE (CD) | eBWE (CD) |
|---|---|---|
| 2 | 0.410244 | 0.3954 |
| 3 | 0.293181 | 0.260144 |
| 4 | 0.21433 | 0.176756 |
| 5 | 0.155101 | 0.122713 |
| 6 | 0.112254 | 0.0866 |
| 7 | 0.081301 | 0.061116 |
| 8 | 0.058495 | 0.043185 |

The values in Table 8 indicate the cepstral distance values, which imply that the coding apparatus according to an exemplary embodiment of the present invention improves the coding performance further than the general coding apparatus.

As set forth above, in a portable terminal which encodes and decodes voice and audio signals using the artificial BWE, the signal is coded by removing information indicative of the characteristic of the high band signal of the signal to be coded. Therefore, an improved coding performance can be accomplished, as compared to the conventional coding apparatus using the BWE.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A coding apparatus using a band extension, the coding apparatus comprising:

a bandwidth extender for extracting second auxiliary information relating to a characteristic of a high band signal using the high band signal and a low band signal; and an encoder for encoding a residual high band signal obtained by subtracting the second auxiliary information from first auxiliary information acquired from the high band signal, wherein the bandwidth extender acquires the second auxiliary information from the low band signal using past pre-coded residual high band signal and the low band signal.

2. The coding apparatus of claim 1, further comprising:

a filter factor calculator for, after the low band signal is encoded, determining filter factors to increase mutual information of the high band signal and encoded low band signal;

a high band mutual information filter for processing to increase the mutual information of the high band signal using the determined filter factors; and a low band mutual information filter for processing to increase the mutual information of the encoded low band signal using the determined filter factors.

3. The coding apparatus of claim 2, further comprising:

a high band estimator for estimating a high band signal using the encoded low band signal of the increased mutual information;

a subtractor for processing to output the residual high band signal by subtracting the estimated high band signal from the high band signal of the increased mutual information; and a quantizer for quantizing and outputting the residual high band signal.

4. The coding apparatus of claim 2, wherein the filter factors to increase the mutual information are configured to reproduce an original signal Y from a converted signal Y2, establish the mutual information I[X;Y2]>I[X;Y]and make a dynamic range of Y2 not be greater than at least a dynamic range of Y in a statistical sense, where X denotes the low band signal, Y denotes the high band signal, H[ ] denotes the high band mutual information filter, $H^{-1}$[ ] denotes a high band mutual information inverse filter, and Y2 denotes a high band signal converted by H [ ].

5. The coding apparatus of claim 2, wherein the filter factors to increase the mutual information are determined using a decoded high band signal and a decoded low band signal.

6. The coding apparatus of claim 2, wherein the mutual information of one of the high band signal and the low band signal is increased.

7. A coding method using a band extension, the coding method comprising:

extracting second auxiliary information relating to a characteristic of a high band signal using the high band signal and a low band signal;

subtracting the second auxiliary information from first auxiliary information acquired from the high band signal; and encoding the subtracted residual high band signal, wherein the extracting of second auxiliary information relating to a characteristic of a high band signal using the high band signal and a low band signal comprises acquiring the second auxiliary information from the low band signal using past pre-coded residual high band signal and the low band signal.

8. The coding method of claim 7, further comprising:

after the low band signal is encoded, determining filter factors to increase mutual information of the high band signal and encoded low band signal; and converting a signal using the increased mutual information of the high band signal and the encoded low band signal using the determined filter factors.

9. The coding method of claim 8, further comprising:

estimating a high band signal using the encoded low band signal of the increased mutual information;

outputting the residual high band signal by subtracting the estimated high band signal from the high band signal of the increased mutual information; and transmitting the output residual high band signal.

10. The coding method of claim 8, wherein the filter factors to increase the mutual information are configured to reproduce an original signal Y from a converted signal Y2, establish the mutual information I[X;Y2]>I[X;Y], and make a dynamic range of Y2 not be greater than at least a dynamic range of Y in a statistical sense, where X denotes the low band signal, Y denotes the high band signal, H[ ] denotes the high band mutual information filter, $H^{-1}$[ ] denotes a high band mutual information inverse filter, and Y2 denotes a high band signal converted by H[ ].

11. The coding method of claim 8, wherein the filter factors to increase the mutual information are determined using a decoded high band signal and a decoded low band signal.

12. The coding method of claim 8, wherein the mutual information of one of the high band signal and the low band signal is increased.

13. A coding apparatus comprising:

a predictor for estimating a high band signal using a pre-decoded high band signal;

a bandwidth extender for receiving an encoded low band signal and for estimating a high band signal using the received encoded low band signal;

a low band encoder for encoding a received low band signal and for providing the encoded low band signal to the bandwidth extender; and an encoder for providing an encoded high band signal.

14. The coding apparatus of claim 13, further comprising a first subtractor for generating a first residual high band signal by subtracting the estimated high band signal of the predictor from the pre-decoded high band signal.

15. The coding apparatus of claim 14, further comprising a second subtractor for generating a second residual high band signal by subtracting the estimated high band signal of the bandwidth extender from the first residual high band signal.

16. The coding apparatus of claim 15, wherein the encoder encodes the second residual high band signal.

* * * * *